US005753813A

United States Patent [19]

Hagiwara

[11] Patent Number: 5,753,813

[45] Date of Patent: May 19, 1998

[54] APPARATUS AND METHOD FOR MONITORING FORMATION COMPACTION WITH IMPROVED ACCURACY

[75] Inventor: Teruhiko Hagiwara, Houston, Tex.

[73] Assignee: Halliburton Energy Services, Inc., Houston, Tex.

[21] Appl. No.: 768,099

[22] Filed: Dec. 16, 1996

Related U.S. Application Data

[63] Continuation of Ser. No. 684,457, Jul. 19, 1996.

[51] Int. Cl.[6] ..... G01V 5/00; E21B 43/119

[52] U.S. Cl. ..... 73/152.54; 73/152.02; 324/326; 324/338; 166/250; 166/255

[58] Field of Search ..... 73/152.54, 152.02; 324/326, 333, 334, 338, 346; 166/250, 254, 255

[56] References Cited

U.S. PATENT DOCUMENTS

| | | | |
|---|---|---|---|
| 2,558,427 | 6/1951 | Fagan | 164/0.5 |
| 3,001,396 | 9/1961 | Cleveland | 73/152 |
| 3,490,150 | 1/1970 | Whitfill, Jr. | 33/133 |
| 4,117,600 | 10/1978 | Guignard et al. | 33/133 |
| 4,396,838 | 8/1983 | Wolcott, Jr. | 250/256 |
| 4,797,822 | 1/1989 | Peters | 364/422 |
| 4,812,977 | 3/1989 | Hulsing, III | 364/422 |
| 5,151,658 | 9/1992 | Maramatsu et al. | 324/346 |
| 5,279,366 | 1/1994 | Scholes | 166/254 |
| 5,351,531 | 10/1994 | Kerr | 73/151 |

OTHER PUBLICATIONS

Precise Distance Measurements with Gamma Ray Logging Tools to Monitor Compaction (PDM) SPWLA 22–ND Annual Loging Symposium Overboom, E., Peeters, M. and Milloy, G. (Jun. 1981), pp. 1–28.

Compaction Monitoring in the Ekofisk Area Chalk Fields; OTC 5620 —Offshore Technology Confer. Menghini, M.L. Phillips Petroleum Co. (May 1988) pp. 31–38.

Subsidence Monitoring in the Gulf Coast; Society of Petroleum Engineers, SPE—22884; Green, E. (Oct. 1991) pp. 1–14.

Developments in Precision Casing Joint and Radioactive Bullet Measurements for Compaction Monitoring; Allen, D.; Society of Petroleum Engineers of AIME; SPE—9933 (Mar. 1981) pp. 1–10.

*Primary Examiner*—Hezron E. Williams
*Assistant Examiner*—J. David Wiggins
*Attorney, Agent, or Firm*—Doug McClellan; Jeffrey C. Hood; Conley, Rose & Tayon

[57] ABSTRACT

Method and an apparatus for determining a vertical distance between a first marker and a second marker embedded in a formation traversed by a borehole so as to quantify the occurrence of earth layer compaction or subsidence. The markers are implanted within a formation and their relative position is monitored over time to detect the presence of formation subsidence and compaction. A tool having three or more detectors adapted to sense signals emitted from the markers is positioned proximate the markers, where the detectors are separated from each other by a known vertical spacing. The tool is positioned at least at three elevations such that a reference elevation of a reference portion of the tool is determined when (a) the first detector detects a signal emitted from the first marker, (b) the second detector senses a signal emitted from the second marker, and (c) the third detector detects a signal emitted from one of the markers. The distance between the two markers may be determined by evaluating a relation that includes the product of a term and a correction factor, the term and the correction factor each being a function of at least two of the reference elevations.

22 Claims, 11 Drawing Sheets

$D = L + \delta; \ \delta = z_2 - z_1$ (1) $D = L + \delta;\ \delta = z_2 - z_1$, (2) $D = L + \Delta - \delta';\ \delta' = z_3 - z_2$ $D = L + \delta$ $\delta/\Delta = (Z_2 - Z_1 + Z_4 - Z_3)/(Z_3 - Z_1 + Z_4 - Z_2)$

APPARATUS AND METHOD FOR MONITORING FORMATION COMPACTION WITH IMPROVED ACCURACY

CONTINUATION DATA

This is a continuation of application Ser. No. 08/684,457, filed Jul. 19, 1996, entitled "Apparatus and Method for Monitoring Formation Compaction with Improved Accuracy" having Teruhiko Hagiwara as its inventor.

BACKGROUND OF THE INVENTION

1. Field of the Invention

The present invention generally relates to an apparatus and method for monitoring formation subsidence by implanting markers in a formation and measuring the shift in position of the markers over time. More particularly, the invention relates to the use of a tool that has three or more detectors that sense signals emitted from the implanted markers. An embodiment of the invention relates to measuring the distance between the markers with the tool and correcting at least some of any measurement error that may occur due to irregular motions that may be experienced by the tool and/or stretching of the tool.

2. Description of the Related Art

Hydrocarbon reservoirs tend to compact as the hydrocarbons within the reservoir are produced or extracted and the fluid pressure in the reservoir decreases. The reduction in pressure may cause a collapsing (i.e., subsidence) of the production zone and/or an overburden that overlies the production zone. An excessive amount of subsidence may result in well casing failure or rig collapse. It is therefore desirable to monitor the local formation to detect the onset of subsidence.

One method of monitoring formation subsidence involves implanting radioactive bullets within the formation. The positions of the bullets are typically monitored at various intervals over a 5–15 year period. A shift in the relative position of the bullets indicates that subsidence may be occurring. The positions of the bullets are typically measured by using a tool that includes a radioactive detector. The tool is aligned vertically and placed alongside the bullets embedded in the formation. The radioactive bullets emit gamma rays that are detected by the radioactive detector when the detector is positioned proximate one of the bullets.

One method to determine the distance between two radioactive bullets involves the use of a tool having a single radioactive detector. An example of this method is illustrated in FIG. 1. The tool is first moved vertically until a radioactive signal emitted from the second marker (M2) is detected by the detector (D1). When the second marker (M2) is detected by the first detector (D1), the elevation of an aboveground portion of the tool is recorded. The tool is again moved vertically and detector (D1) detects the first marker (M1). The elevation of the aboveground portion of the tool is then recorded and the difference in the recorded elevations is estimated to be the vertical distance D between the two radioactive bullets.

The tool commonly includes a cable attached to a casing that houses the detector. The tool tends to experience irregular motions as it is moved vertically in a borehole within the formation. The tool may experience a "yo-yoing" or bouncing motion due to the dragging of the tool and/or the vibrating of the winch that is commonly used to raise or lower the tool. In addition, the cable may tend to stretch due to its own weight and/or dragging. Thus, elevation changes of a portion of the tool measured above the surface of the formation often do not indicate the true elevation changes of the tool within the formation. Thus, the elevation change of the tool that is measured above the formation surface may significantly differ from the true vertical distance between the two bullets. The above-described method using one detector is typically subject to significant error induced by the irregular tool motions and/or cable stretching because the tool must travel the entire vertical distance between the two markers to perform the necessary measurements.

To reduce the measurement errors induced by the irregular tool motions and cable stretching, a tool containing two detectors has been used to determine the vertical distance D between two embedded bullets. The two detectors are separated by a known spacing L as shown in FIG. 2. The spacing L is selected to be as close as possible to the vertical distance between the two bullets. The tool is positioned such that the first detector (D1) detects the gamma rays emitted from the first bullet (M1), at which point an elevation $z_1$ of an aboveground portion of the tool is measured. The tool is then moved vertically as shown in FIG. 2 until the second detector (D2) detects the second bullet (M2), at which point an elevation $z_2$ of the aboveground portion of the tool is measured. The distance traveled by the tool casing, $\delta$, is estimated to be the difference in the measured elevations, $z_2-z_1$. The distance D is estimated to be the sum of spacing L and distance $\delta$. The distance $\delta$ tends to be much smaller than the distance D, so the tool moves a shorter distance to make the necessary measurements than in the above-described method of using one detector. Thus, the measurement error introduced by the irregular tool motions and cable stretching tends to be lower when a two-detector tool is employed in the above-described manner as compared to methods involving a single-detector tool.

Other methods relate to the use of more than two detectors to measure the vertical distance between two bullets. The use of additional detectors has made possible an increased number of independent pair measurements for a given pair of bullets. The independent measurements may be used to obtain more than one estimate of the vertical distance D, and the estimates may be averaged. In addition, achieving an accurate estimate of distance D by conventional methods tends to require that the spacing between a pair of detectors be very close to the distance between the two bullets. The use of additional detectors increases the possibility that two of the detectors will be separated by a spacing L that is close to the distance D.

An example of the use of three detectors is shown in FIG. 3. As shown, a first detector (D1) and a second detector (D2) are separated by a known distance L, and the first detector (D1) and a third detector (D3) are separated by a known distance $\Delta$. The tool is positioned so that the first detector (D1) senses the gamma rays of the first bullet and elevation $z_1$ is recorded. The tool is then moved vertically and elevation $z_2$ is recorded when the second detector (D2) detects the gamma rays emitted from the second bullet (M2). Elevation $z_3$ is recorded when the third detector (D3) senses the gamma rays emitted from the first bullet (M1). Two estimates of distance D are made from these recorded elevations. The first estimate of D is calculated as the sum of spacing L and the elevation difference $z_2-z_1$. The second estimate of D is calculated as the elevation difference $z_3-z_2$ subtracted from the sum of spacing L and spacing $\Delta$. The first estimate and second estimate of distance D can be averaged. The first estimate of D is generally considered to be more accurate than the second estimate of D if elevation difference $z_2-z_1$ is much smaller than the elevation difference $z_3-z_2$. In the case that elevation difference $z_3-z_2$ is much smaller than elevation difference $z_2-z_1$, the second estimate of D is generally considered to be more accurate than the first estimate of D.

Society of Petroleum Engineers paper No. 22884 by D. E. Green, entitled "Subsidence Monitoring in the Gulf Coast", relates to the use of a tool having three detectors to measure radioactive marker spacing and casing collar joint lengths to monitor formation subsidence. A single pass of the tool provides two independent measurements of the marker spacing.

Society of Petroleum Engineers paper No. 9933 by Dennis R. Allen, entitled "Developments in Precision Casing Joint and Radioactive Bullet Measurements for Compaction Monitoring," relates to the use of a tool having two detectors and odometer wheels to measure radioactive marker spacing.

Offshore Technology Conference paper No. 5620 by M. L. Menghini, entitled "Compaction Monitoring in the Ekofisk Area Chalk Fields," relates to the use of a tool having four detectors to obtain four independent measurements of radioactive marker spacing in a single pass of the tool.

The paper entitled "Precise Distance Measurements With Gamma-Ray Logging Tools to Monitor Compaction", by E. J. M. Overboom, M. Peeters, and G. Milloy, relates to the use of a two detector tool to measure the spacing between radioactive bullets implanted in a formation. Methods of interpreting logging data are also presented.

The above methods do not always provide an adequate estimation of the distance D between the two markers. Therefore, an improved apparatus and method is desired which provides improved estimation of the compaction or subsidence within a formation.

The above-mentioned papers are incorporated by reference herein as though fully and completely set forth herein.

SUMMARY OF THE INVENTION

The present invention generally relates to the use of a tool having three or more detectors to estimate the vertical distance D between a first marker and a second marker that are embedded in a formation. The present invention allows the determination of the distance D between the first and second markers with improved accuracy.

An embodiment of the invention relates to positioning a tool having three detectors proximate a first and second marker that are embedded in a formation. The first and second markers emit signals (e.g., gamma rays) that are detected by the detectors when the detectors are at the same elevation as one of the markers. The tool is positioned at various elevations such that (a) the first detector detects a signal emitted from the first marker, (b) the second detector detects a signal emitted from the second marker, and (c) the third detector detects a signal emitted from either one of the markers. A reference portion of the tool is measured and reference elevations $z_1$, $z_2$, and $z_3$ are determined when the first detector detects the first marker, the second detector detects the second marker, and the third detector detects either one of the markers, respectively. Two of the detectors are preferably located on the tool at a known vertical spacing $\Delta$ from each other. A known spacing L preferably exists between the first detector and the second detector. An estimate of the vertical distance D between the two markers is preferably determined by using a mathematical relationship that is a function of the spacing L, the spacing $\Delta$, and the three measured reference elevations. The estimate of distance D at least partially compensates for measurement error induced by irregular tool motions and/or cable stretching.

Another embodiment of the invention relates to positioning a tool having four detectors proximate a first marker and a second marker that are embedded in a formation. The first and second markers may emit signals (e.g., gamma rays) that are detected by the detectors when the detectors are at the same elevation as one of the markers. The tool is positioned at various elevations such that (a) the first detector detects a signal emitted from the first marker, (b) the second detector detects a signal emitted from the second marker, (c) the third detector detects a signal emitted from the first marker, and (d) the fourth detector detects a signal emitted from the second marker. A reference portion of the tool is measured and reference elevations $z_1$, $z_2$, $z_3$, and $z_4$ are determined when the first detector detects the first marker, the second detector detects the second marker, the third detector detects the third marker, and the fourth detector detects the second marker, respectively. A known vertical spacing $\Delta$ preferably exists between both (a) the first detector and the third detector and (b) the second detector and the fourth detector. A known vertical spacing L may exist between the first detector and the second detector. An estimate of the vertical distance D between the two markers may be determined by using a mathematical relationship that is a function of the spacing L, the spacing $\Delta$, and the four measured reference elevations. The estimate of distance D at least partially compensates for measurement error induced by irregular tool motions and/or cable stretching.

Yet another embodiment of the invention relates to determining a vertical distance between two embedded markers by using a tool having three or more detectors and a correction factor to at least partially compensate for measurement error induced by irregular tool motions and/or cable stretching. The correction factor may be a function of (a) a known spacing $\Delta$ between a pair of detectors on the tool and (b) reference elevations measured when the detectors sense a signal emitted from an embedded marker. The correction factor may be a measure of the proportional difference between (a) the elevation change of a reference portion of the tool and (b) the elevation change of a casing of the tool that houses the detectors and is proximate the markers that are embedded in a formation. The correction factor may be multiplied by a term (e.g., reference elevation difference, sum of reference elevation differences, etc.) to obtain the difference between (a) the vertical distance between the two embedded markers and (b) the spacing distance between two of the detectors.

Another embodiment of the invention relates to an automatic monitoring system that measures reference elevations of a portion of a tool. The automatic monitoring system is preferably adapted to receive signals from the detectors of the tool. The signals relayed from the detectors to the monitoring system prompt the system to perform a reference elevation measurement or recordation. The automatic monitoring system preferably includes a computer to perform calculations involving the measured reference elevations to determine a correction factor and the distance between a pair of embedded markers.

An aspect of the invention relates to determining the vertical distance between a pair of markers embedded in a formation that at least partially compensates for measurement error due to irregular tool motions and/or cable stretching.

Another aspect of the invention relates to formulating expressions used in the determination of a vertical distance between two markers by a tool having three or more detectors.

Additional aspects, objects, and advantages of the invention will become apparent to those skilled in the art upon examination of the following detailed description.

DESCRIPTION OF THE PREFERRED EMBODIMENTS

Figure 4:
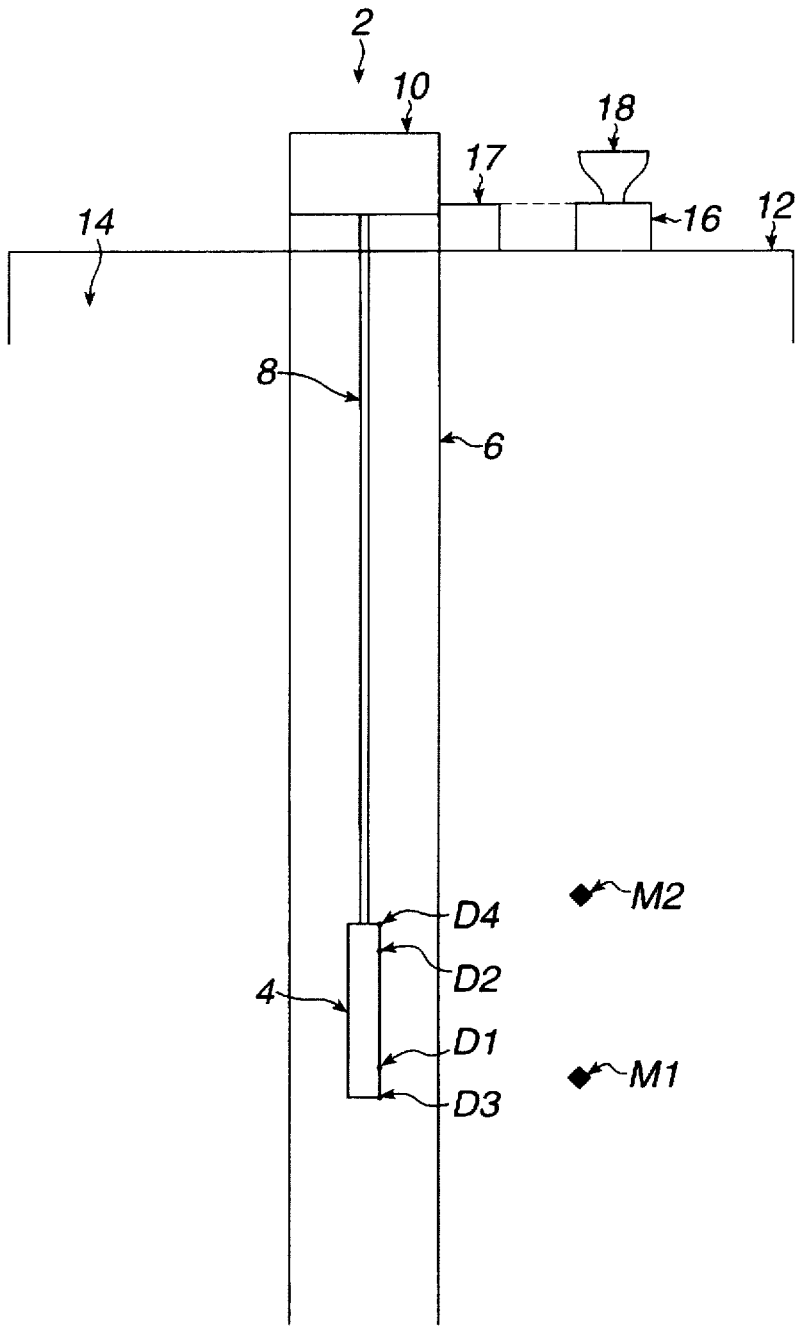
FIG. 4 depicts an embodiment of a formation subsidence monitoring tool positioned within a formation.

An embodiment of the invention is depicted in FIG. 4. A first marker (M1) and a second marker (M2) are embedded in a formation. The markers may be attached to well casing 6. It is desired to monitor the positions of the markers over time to detect the presence of formation subsidence. A tool 2 for determining the distance between markers (M1) and (M2) is located below the surface 12 of a formation 14. Tool 2 may be substantially surrounded by well casing 6 or a similar structure, or the tool may simply be positioned within an "open hole" in the formation. Tool 2 preferably contains a tool casing 4 that houses at least three detectors. The detectors (e.g., D1, D2, D3, and D4) may be located on the surface of tool casing 4. The tool preferably includes a cable 8 that connects casing 4 with a tool positioning device 10. Tool positioning device 10 is used to raise and lower tool 2 via cable 8. Tool positioning device 10 preferably includes a winch or similar device. The tool 2 is preferably substantially straight and vertical as it is moved within the formation.

Cable 8 may contain reference markings to allow a precise determination of the length of the cable that has been lowered within formation 14 or raised above the surface 12 of the formation. In an embodiment, cable 8 contains a reference portion having magnetized portions at regular intervals. As the cable is raised or lowered, the magnetized portions are detected by a magnetometer 17 to allow determination of the length of cable raised or lowered. The magnetometer sends electronic signals to automatic monitoring system 16. A computer 18 is coupled to automatic monitoring system 16 to perform calculations to determine distance D, as will be discussed in the following.

The first marker (M1) and the second marker (M2) are preferably bullets that are projected into the formation by a gun or other projecting device. Such devices are well known to those skilled in the art. The first marker (M1) and the second marker (M2) are preferably projected into the formation such that the vertical distance D between the markers is between about 5 feet and about 40 feet, and more preferably either about 10 feet or about 30 feet. The first marker and the second marker preferably contain a radioactive source that emits radioactive signals (e.g., gamma rays). It is noted that other types of devices that emit radioactive waves or electromagnetic waves may serve as the first and/or second markers.

In one embodiment of the invention, the radioactive source contained within the first marker and the second marker is Cs-137. In an alternate embodiment, the radioactive source is Co-60. Cs-137 is generally preferred over Co-60 since the half-life of Cs-137 is about 30 years, whereas the half-life of Co-60 is only about 5 years. The markers are typically monitored at various intervals over about a 5–15 year period, and the relatively short half life of Co-60 tends to require that relatively large doses of the source must be implanted into the marker. In other embodiments, however, Co-60 is preferred since it emits higher energy gamma radiation than Cs-137, making the detection of the radiation easier when the source is implanted relatively deep in a formation. In an alternate embodiment, the first and second markers contain a permanent magnet that emits a signal such as a magnetic field. The radioactive source preferably has a strength of less than about 50 μC, more preferably between about 5 μC and about 40 μC, and more preferably still about 10 μC. The radioactive strength of the source may be chosen as a function of the depth of the marker containing the source.

Figure 3:
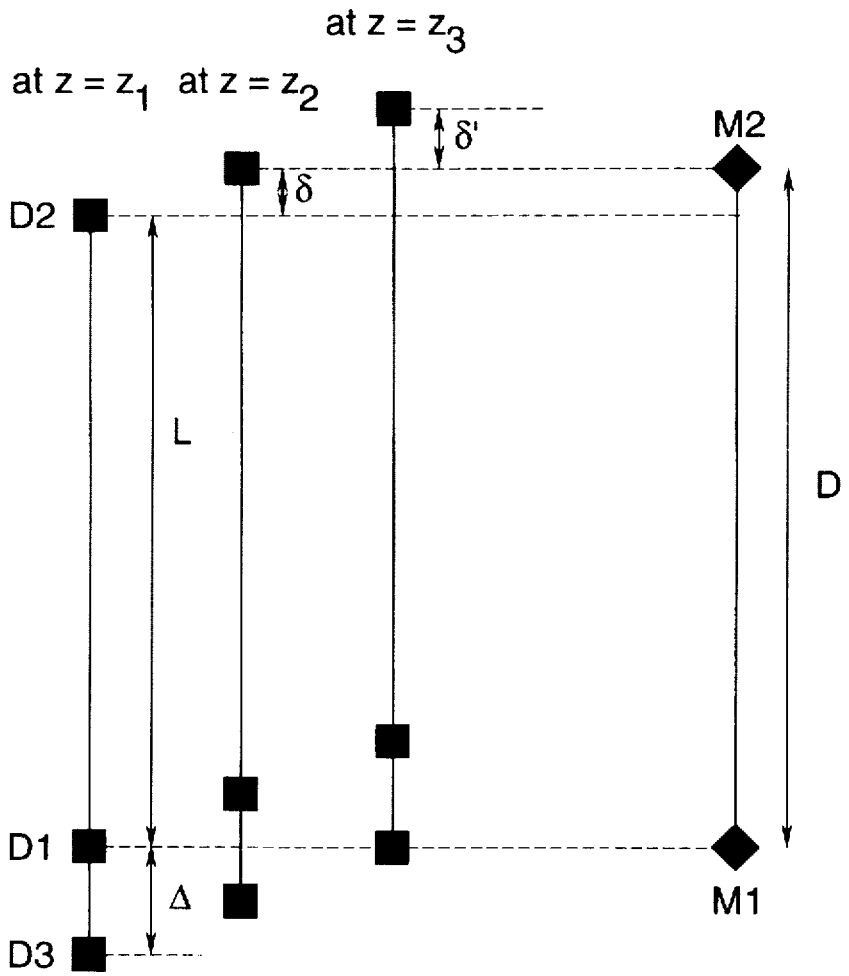
Prior Art Fig. 3
FIG. 3 illustrates a prior art method for detecting formation subsidence using a tool having three detectors.

In an embodiment of the invention, the vertical distance D between the first marker and the second marker is estimated using a tool having more than two detectors. The tool preferably contains a first detector and a second detector that are spaced apart on the tool by a vertical spacing L. The vertical spacing L is preferably known. The vertical spacing L is preferably close to the vertical distance between the first marker and the second marker. The tool preferably contains a third detector that is spaced from the first detector at a vertical spacing Δ. The vertical spacings L and Δ preferably are precisely measured with a ruler or similar device before the tool is positioned within the formation. In an embodiment, the spacing Δ is preferably less than about 2 feet, more preferably between about 6 inches and about 18 inches, and more preferably still about 1 foot. Each of the detectors is preferably adapted to sense signals emitted from at least one of the markers embedded in the formation. It is preferred that the signal emitted from the markers allows the determination of the precise point when a detector and an embedded marker are at the same elevation. The vertical spacing between the second detector and the third detector is preferably the sum of spacing L and spacing Δ as shown in FIG. 3. The tool may be next positioned proximate at least one of the markers. The tool is preferably positioned proximate the markers such that a lateral (i.e., horizontal) distance of less than about 1 foot exists between a detector and a marker when the detector senses the signal emitted from the marker.

Figure 5:
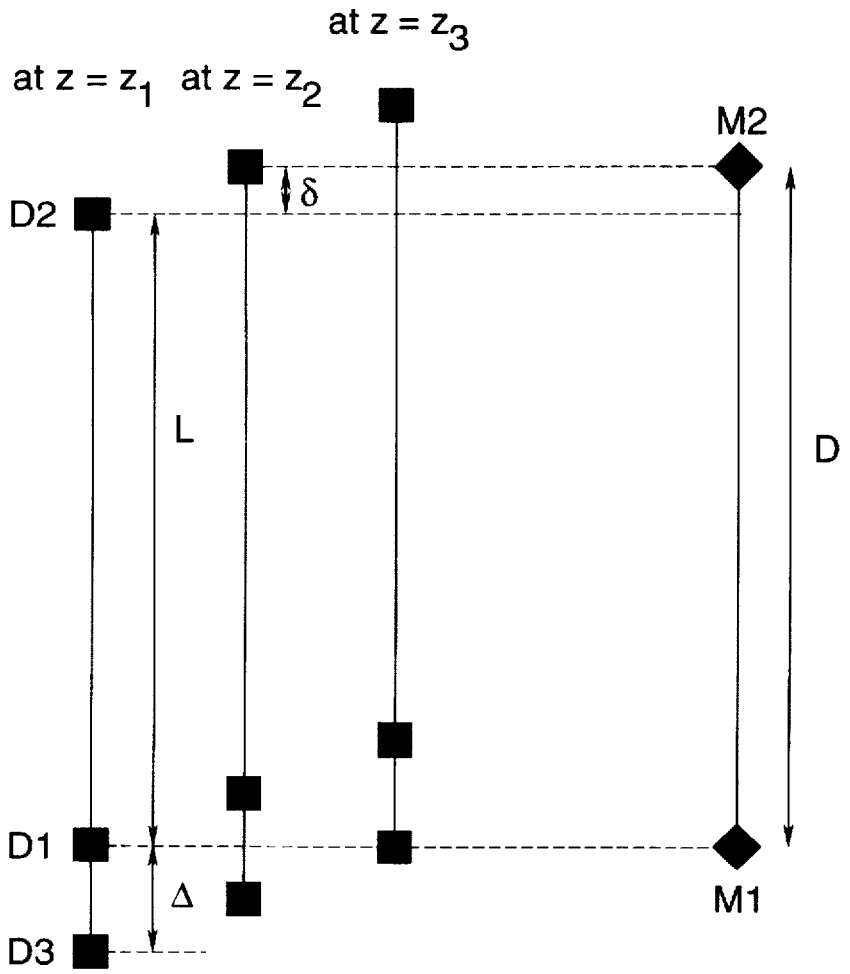
FIG. 5 illustrates an embodiment of the invention for detecting formation subsidence using a tool having three detectors.

In an embodiment, the tool contains three detectors configured as shown in FIG. 5. The first detector and the second detector are separated by a known vertical spacing L. The first detector and the third detector are separated by a known spacing distance Δ. The first detector is preferably located between the second detector and the third detector such that the vertical spacing between the second detector and the third detector is the sum of spacing L and spacing Δ. The tool is aligned such that the first detector senses a signal emitted by the first marker. At this point, the elevation $z_1$ of a reference portion of the tool is determined and recorded. The reference portion of the tool may be located at any location along the length of the tool and is preferably located aboveground to facilitate its measurement. The tool is positioned (e.g., moved vertically) such that the second detector detects a signal emitted by the second marker, at which point the elevation $z_2$ of the reference portion of the tool is determined and recorded. The tool is then positioned such that the third detector detects a signal emitted from the first marker, at which point the elevation $z_3$ of the reference portion of the tool is determined and recorded. The distance δ is the difference between the distance D that exists between the first marker and the second marker and the length L that exists between the first detector and the second detector. That is, δ=D−L. It is to be understood that in alternate embodiments the length L between a first detector and a second detector may exceed the distance D between the first marker and the second marker. In such a case, the distance δ may be the difference between distance L and distance D such that δ=L−D.

It is to be understood that the reference elevations (e.g., $z_1$, $z_2$, $z_3$, etc.) may be depths of a reference portion of the tool below a reference point (e.g., the formation surface, winch). The reference elevations may also be "theoretical elevations" determined by the length of cable 8 that is raised above the surface of the formation or lowered within the formation. For instance, the reference portion of the tool may be a portion of cable 8 that is coiled around a winch. In such a case, the reference elevation may be considered to be the elevation that would be reached by the reference portion if cable 8 was substantially straight and vertical. The cable may contain markings (e.g. magnetized portions) to allow the determination of the length of cable 8 that has been coiled onto the winch or uncoiled from the winch. Alternately, the winch may raise or lower cable 8 at a known speed(s) such that reference elevation can be calculated with knowledge of the cable speed and the time period that the cable is raised or lowered.

In the above-described embodiment illustrated in FIG. 4, the measured elevations $z_1$, $z_2$, and $z_3$ may be described as a function of the true elevation of the first detector $z_0$ by the following relationships:

$$z_1=g(z_0),$$

$$z_2=g(z_0+\delta), \text{ and}$$

$$z_3=g(z_0+\Delta).$$

If distances Δ and δ are relatively small, the reference elevations $z_1$, $z_2$, and $z_3$ may be described by the following truncated Taylor approximation polynomials:

$$z_1=g(z_0),$$

$$z_1=g(z_0)+\delta g'(z_0)+\delta^2/2g''(z_0), \text{ and}$$

$$z_3=g(z_0)+\Delta g'(z_0)+\Delta^2/2g''(z_0).$$

It can easily be shown that $$z_2-z_1=\delta[g'(z_0)+\delta/2g''(z_0)] \text{ and}$$

$$z_3-z_1=\Delta[g'(z_0)+\Delta/2g''(z_0)].$$

With the assumption that $\Delta g''(z_0)$ and $\delta g''(z_0)$ are each much smaller than $g'(z_0)$, the ratio of δ to Δ may be expressed as:

$$\delta/\Delta=(z_2-z_1)/(z_3-z_1).$$

The distance Δ is known, and so the distance δ (i.e., the true net elevation change of the first detector in the time between the detection of the first marker by the first detector and the detection of the second marker by the second detector) may be determined with knowledge of reference elevations $z_1$, $z_2$, and $z_3$ as described above. The vertical distance D between the two markers is the sum of the known spacing L and the distance δ.

A three detector tool may be used to make two independent estimates of the vertical distance D. Such a method, however, largely ignores the irregular tool motions and cable stretching that tend to occur as the tool is moved within the formation. For instance, if a portion of the cable between the tool casing and the reference portion of the tool stretches, the assumption that $\delta=z_2-z_1$ may contain significant error. Such stretching of the cable may be due to the weight of the tool and/or the dragging of the tool due to friction between the tool and the local geostructure within the formation. In such cases, the measured elevation difference $z_2-z_1$ of the reference portion of the tool may overestimate the true elevation difference δ traveled by the first detector, resulting in a estimate of distance D that exceeds the true value. In the same manner, a second, redundant estimate of distance D would tend to exceed the true value of D. Such errors in the two estimates of D tend not to negate one another since both estimates would exceed the true value of D. The average value of D tends to have an error smaller than one of the estimates of D but larger than the other estimate of D.

In an embodiment of the invention, a three detector tool is used as described above and shown in FIG. 5, and a single estimate of D is made by using the relationship $\delta=cf(z_2-z_1)$, where cf is a correction factor that accounts for errors typically induced by irregular tool motions and cable stretching. In an embodiment, the correction factor is the ratio $\Delta/(z_3-z_1)$. Such a correction factor is based on the idea that the elevation difference $z_3-z_1$ term differs from spacing Δ by about the same proportion that the elevation difference $z_2-z_1$ differs from distance δ. The tool casing is preferably made of metal and tends not to experience stretching in the manner that the cable can. Therefore, the spacing Δ should be equal to the true elevation difference of the third detector between its position when the first detector detects the first marker and the position of the third detector when it detects the first marker. Likewise, it is preferred that the detectors remain at a fixed relative position within the tool casing such that all of the detectors experience a substantially identical elevation change as the tool is positioned. Thus, spacing Δ may serve as a calibration factor to correct error induced by irregular tool motions and cable stretching. Once distance δ is determined, a single estimate of D may be found by summing the known spacing L with the calculated distance δ.

In the above-mentioned embodiment illustrated by FIG. 5, the tool has a spacing distance between the second detector and the third detector (i.e., L+Δ) that is greater than the distance D between the first marker and the second marker. It is to be understood that a tool may be used that has three detectors with a spacing distance between the second detector and the third detector (i.e., L+Δ) that is less than the distance D between the first marker and the second marker.

Figure 6:
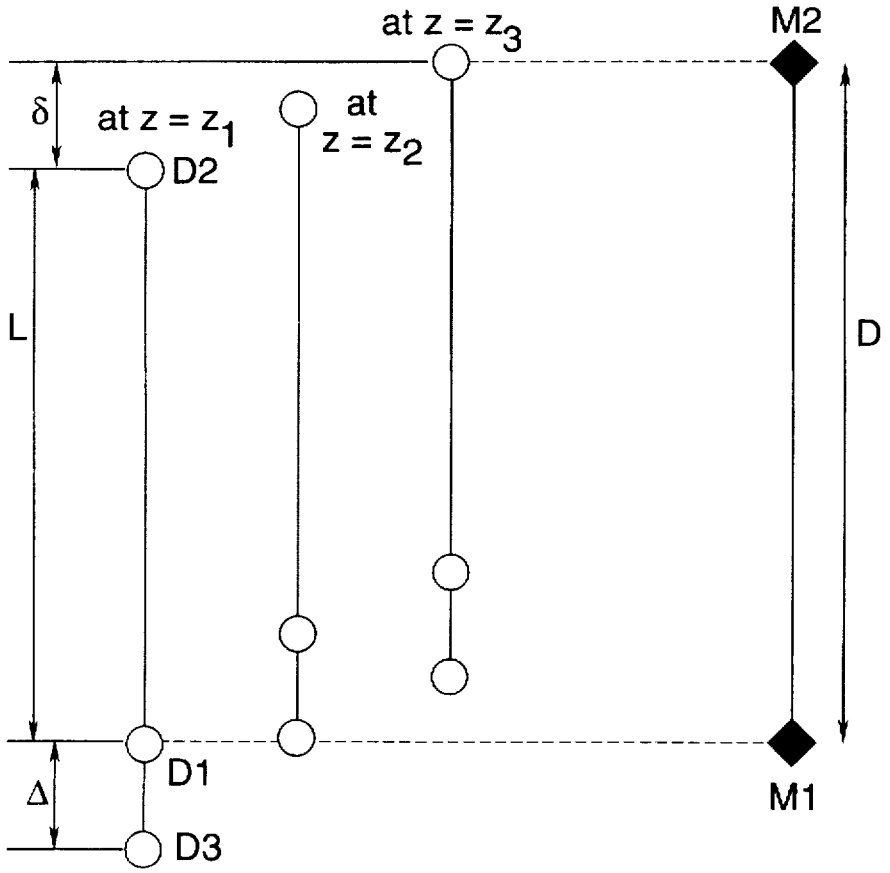
FIG. 6 illustrates an embodiment of the invention for detecting formation subsidence using a tool having three detectors.

In an embodiment of the invention depicted in FIG. 6, the tool has three detectors. The first detector (D1) lies between the second detector (D2) and the third detector (D3). A spacing distance L exists between the second detector and the first detector, and a spacing distance Δ exists between the third detector and the first detector. The spacing distance between the second detector and the first detector (i.e., L+Δ) is less than the distance D between the first marker and the second marker. The tool is positioned such that the first detector senses a signal emitted from the first marker (M1), at which point a first reference elevation $z_1$ is determined and recorded. The tool is positioned such that the third detector senses a signal emitted from the first marker M1, at which point a second reference elevation $z_2$ is determined and recorded. The tool is positioned such that the second detector senses a signal emitted from the second marker (M2), at which point a third reference elevation $z_3$ is determined and recorded.

In the embodiment of the invention illustrated by FIG. 6, a single estimate of D is made by using the relationship $\delta=cf(z_3-z_1)$, where cf is a correction factor that accounts for errors typically induced by irregular tool motions and cable stretching. In an embodiment, the correction factor is the ratio $\Delta/(z_2-z_1)$. Such a correction factor is based on the idea that the elevation difference $z_2-z_1$ differs from spacing Δ by about the same proportion that the elevation difference term $z_3-z_1$ differs from distance δ. Spacing Δ may be used as a calibration factor to correct error induced by irregular tool motions and cable stretching. Once distance δ is determined, a single estimate of D may be found by summing the known spacing L with the calculated distance δ.

It is also to be understood that the tool may be lowered as successive reference elevation determinations are made. In an embodiment of the invention illustrated by FIG. 7, a tool having three detectors is used to determine the vertical distance D between the first marker (M1) and the second marker (M2). An elevation $z_1$ of a portion of the tool is determined and recorded at the point when second detector (D2) senses a signal emitted from the second marker. An elevation $z_2$ of the reference portion of the tool is determined and recorded at the point when third detector (D3) senses a signal emitted from the first marker. An elevation $z_3$ of the reference portion of the tool is determined and recorded at the point when first detector D1 senses a signal emitted from the first marker. Elevation $z_1$ may be greater than the elevation $z_2$, and elevation $z_2$ may be greater than elevation $z_3$. The distance δ may be calculated by using the following relationship:

$$\delta=\Delta(z_1-z_2)/(z_2-z_3).$$

The movement of the tool in between the measuring of elevation $z_2$ and elevation $z_3$ is preferably a calibration movement to collect data to correct the error induced by irregular tool motions, cable stretching, etc. In this embodiment, elevation difference $(z_2-z_3)$ preferably differs from spacing distance Δ by the same proportion that elevation difference $(z_1-z_2)$ differs from distance δ such that a correction factor of $\Delta/(z_2-z_3)$ exists.

Figure 8:
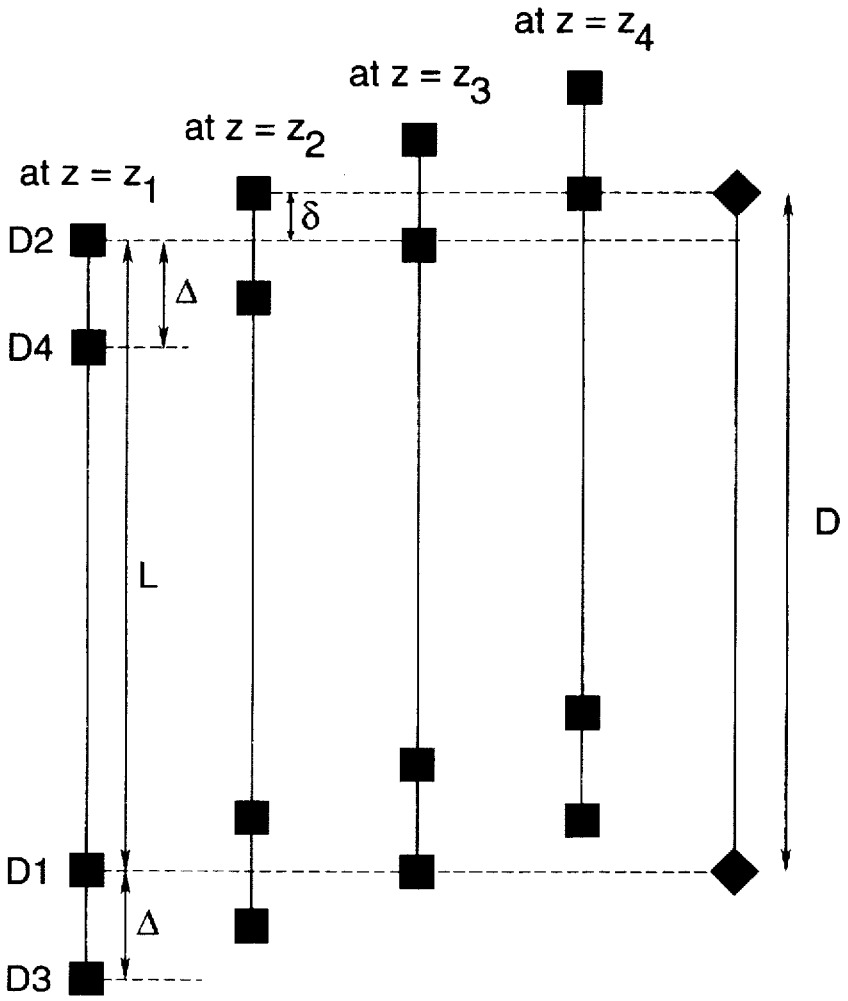
FIG. 8 illustrates an embodiment of the invention for detecting formation subsidence using a tool having four detectors.

In an embodiment of the invention, a tool having four detectors configured as in FIG. 8 is used to determine the vertical distance D between first marker (M1) and second marker (M2). It is preferred that a known vertical spacing L exists between the first marker and the second marker. A known vertical spacing Δ preferably exists between second detector (D2) and fourth detector (D4) and between first detector (D1) and third detector (D3) such that the vertical spacing between the second detector and the third detector is the sum of spacing L and spacing Δ. The tool is positioned such that the first detector senses a signal emitted from the first marker, at which time the elevation $z_1$ of a reference portion of the tool is determined and recorded. The tool is moved vertically and the second detector senses a signal emitted from the second marker, at which time the elevation $z_2$ of the reference portion of the tool is determined and recorded. As the tool is moved from reference elevation $z_1$ to reference elevation $z_2$, the true change in elevation of the first detector is preferably distance δ as shown in FIG. 8. The tool is moved vertically and the elevation $z_3$ is determined and recorded when the third detector senses a signal emitted by the first marker. The tool is positioned such that the fourth detector senses a signal emitted from the second marker, at which time the elevation $z_4$ of the reference portion of the tool is determined and recorded.

For the above-described embodiment illustrated by FIG. 8, the measured elevations $z_1$, $z_2$, $z_3$, and $z_4$ may be described as a function of the true elevation of the first detector $z_0$ by the following relationships:

$$z_1=g(z_0),$$

$$z_2=g(z_0+\delta),$$

$$z_3=g(z_0+\Delta), \text{ and}$$

$$z_4=g(z_0+\Delta+\delta).$$

If distances Δ and δ are relatively small, the reference elevations $z_1$, $z_2$, $z_3$, and $z_4$ may be described by the following truncated Taylor approximation polynomials:

$$z_1=g(z_0),$$

$$z_2=g(z_0)+\delta g'(z_0)+\delta^2/2g''(z_0),$$

$$z_3=g(z_0)+\Delta g'(z_0)+\Delta^2/2g''(z_0), \text{ and}$$

$$z_4=g(z_0)+(\delta+\Delta)g'(z_0)+(\Delta+\delta)^2/2g''(z_0).$$

It can easily be shown that $$z_2-z_1=\delta g'(z_0)+\delta^2/2g''(z_0) \text{ and}$$

$$z_4-z_3=\delta g'(z_0)+(\Delta\delta+\delta^2/2)g''(z_0).$$

Thus, $$z_2-z_1+z_4-z_3=2\delta\{g'(z_0)+(\Delta+\delta)/2g''(z_0)\}.$$

In the same manner, $$z_3-z_1=\Delta g''(z_0)+\Delta^2/2g''(z_0) \text{ and}$$

$$z_4-z_2=\Delta g'(z_0)+(\Delta\delta+\Delta^2/2)g''(z_0).$$

Thus, $$z_3-z_1+z_4-z_2=2\Delta\{g'(z_0)+(\Delta+\delta)/2g''(z_0)\}.$$

Consequently, the ratio of δ to Δ may be written as follows:

$$\delta/\Delta=(z_2-z_1+z_4-z_3)/(z_3-z_1+z_4-z_2).$$

The distance $\Delta$ is known, and so the distance $\delta$ may be determined with knowledge of reference elevations $z_1$, $z_2$, $z_3$, and $z_4$ as described above. It should be understood that conventional methods that employ a tool with two detectors estimate the distance $\delta$ to simply be $z_2-z_1$. Such an estimate, however, is only accurate for the case in which $g'(z_0)=1$ and $g''(z_0)=0$. Reference logging elevation differences that are measured above the surface of the formation are generally not identical to the true elevation changes of the tool casing within the formation because of the irregular tool motions and cable stretching that tend to occur.

In another embodiment of the invention illustrated in FIG. 9, a tool containing four detectors is used to determine the vertical distance D between a pair of embedded markers in the following manner. The spacing between the second detector and the third detector along the tool (i.e., $L+\Delta$) is less than distance D. That is, the vertical distance D is greater than each of the various spacing distances that exists between the detectors. In such a case, the spacing $\Delta$ is less than distance $\delta$. The tool is positioned such that the first detector (D1) senses a signal emitted from first marker (M1). Reference elevation $z_1$ is determined and recorded at this point. The tool is positioned such that third detector (D3) senses a signal emitted from the first marker, at which point the reference elevation $z_2$ is determined and recorded. The tool is positioned such that second detector (D2) senses a signal emitted from second marker (M2), and the reference elevation $z_3$ is determined and recorded. The tool is positioned such that the fourth detector senses a signal from the second marker, at which point the reference elevation $z_4$ is determined and recorded.

Figure 9:
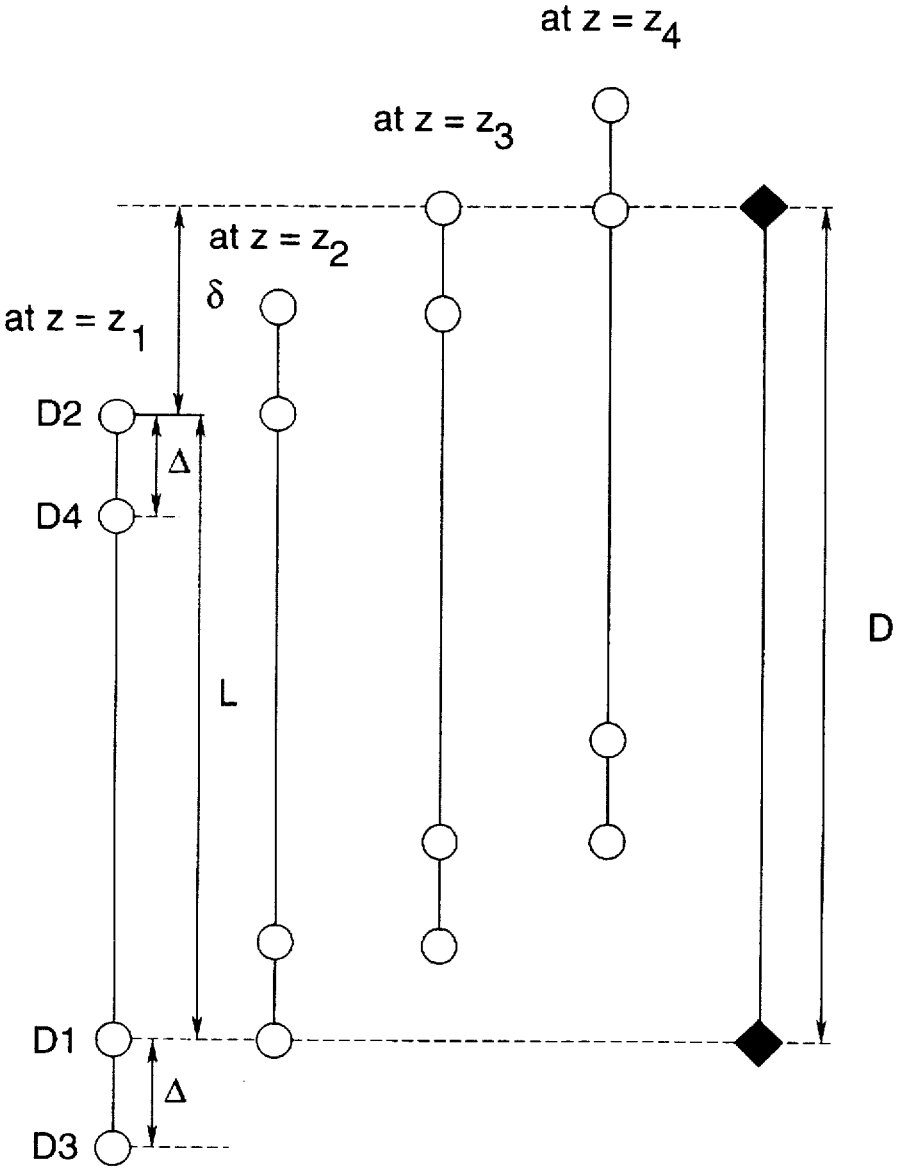
FIG. 9 illustrates an embodiment of the invention for detecting formation subsidence using a tool having four detectors.

In the embodiment illustrated by FIG. 9, distance $\delta$ can be determined with knowledge of spacing $\Delta$, spacing L, and the four measured reference elevations, $z_1-z_4$. In the absence of irregular tool motions, cable stretching, etc., the elevation differences $z_2-z_1$ and $z_4-z_3$ should each equal spacing $\Delta$, and the elevation differences $z_4-z_2$ and $z_3-z_1$ should each equal distance $\delta$. Distance $\delta$ may be described by the following relationship:

$$2\delta=\{(z_4-z_2)+(z_3-z_1)\}cf,$$

where cf is a correction factor to account for the irregular tool motions and cable stretching. In an ideal case in which no irregular tool motions or cable stretching occur, the value of the correction factor should be unity, and distance $\delta$ may be estimated by either elevation difference $z_4-z_2$ or elevation difference $z_3-z_1$. With irregular tool motions and/or spacing, the correction factor (cf) may be $2\Delta/\{(z_2-z_1)+(z_4-z_3)\}$. Since spacing $\Delta$ is known, the distance $\delta$ may be determined by the following relationship:

$$\delta=\Delta\{(z_4-z_2)+(z_3-z_1)\}/\{(z_2-z_1)+(z_4-z_3)\}.$$

Figure 10:
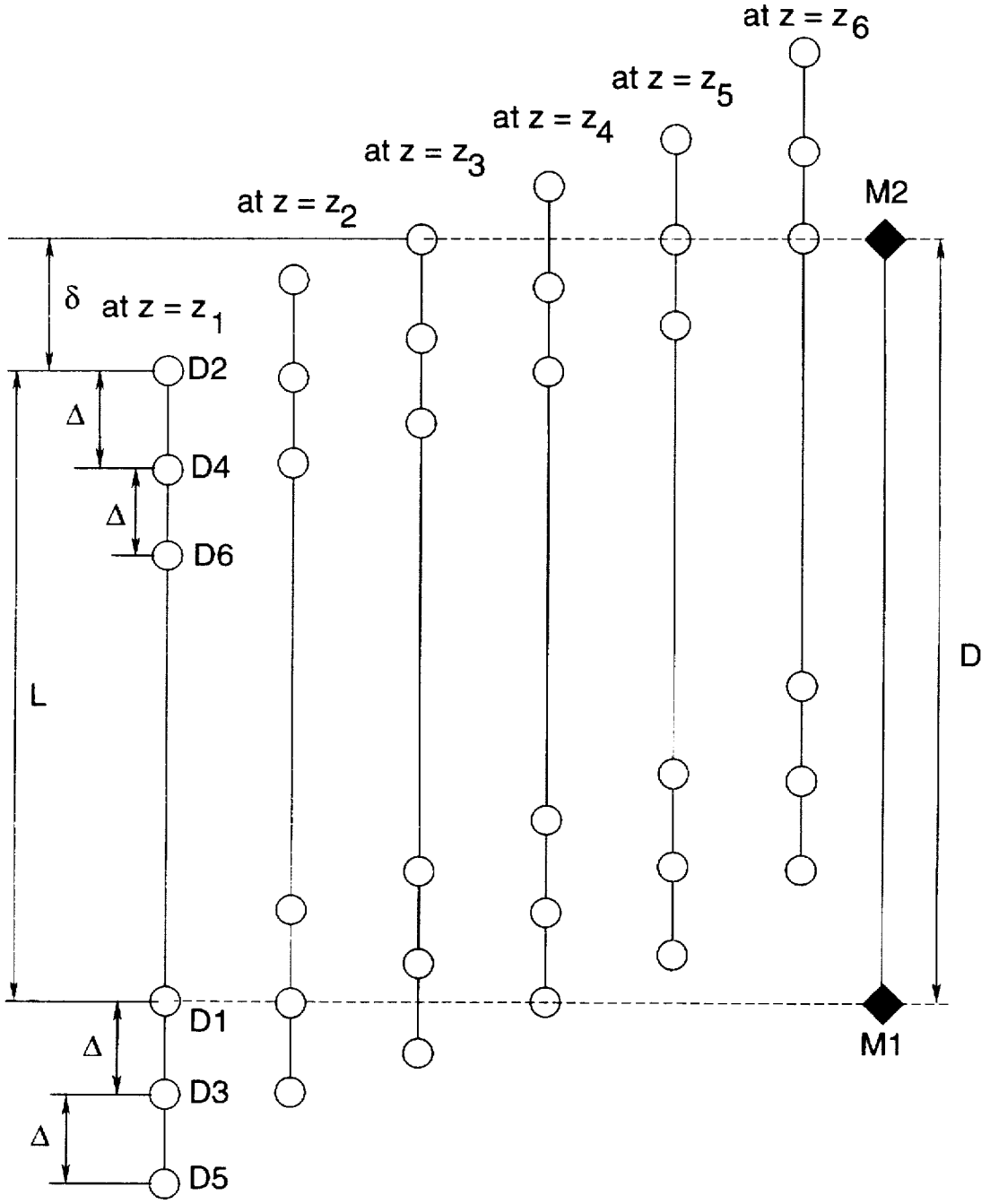
FIG. 10 illustrates an embodiment of the invention for detecting formation subsidence using a tool having six detectors.

In an embodiment, a tool containing six detectors is used to determine vertical distance D between first marker (M1) and second marker (M2) in the following manner. As shown in FIG. 10, a known spacing $\Delta$ exists between each of (a) second detector (D2) and fourth detector (D4), (b) fourth detector (D4) and sixth detector (D6), (c) first detector (D1) and third detector (D3), and (d) third detector (D3) and fifth detector (D5). The spacing L is the distance between the second detector and the first detector. The fourth detector is located between the second detector and the sixth detector, and the third detector is located between the first detector and the fifth detector as illustrated in FIG. 10. The tool is preferably positioned at least at six locations so that at least six reference elevations may be recorded. It is preferred that a reference elevation be determined and recorded as (a) the first detector senses a signal emitted by the first marker, (b) the third detector senses a signal emitted by the first marker, (c) the second detector senses a signal emitted by the second marker, (d) the fifth detector senses a signal emitted by the first marker, (e) the fourth detector senses a signal emitted by the second marker, and (f) the sixth detector senses a signal emitted by the second marker.

For the above-described embodiment illustrated by FIG. 10, the measured elevations $z_1$, $z_2$, $z_3$, $z_4$, $z_5$ and $z_6$ may be described as a function of the true elevation $z_0$ of the first detector by the following relationships:

$$z_1=g(z_0),$$

$$z_2=g(z_0+\Delta),$$

$$z_3=g(z_0+\delta)$$

$$z_4=g(z_0+2\Delta),$$

$$z_5=g(z_0+\delta+\Delta), \text{ and}$$

$$z_6=g(z_0+\delta+2\Delta).$$

If distances $\Delta$ and $\delta$ are relatively small, the reference elevations $z_1$, $z_2$, $z_3$, and $z_4$ may be described by the following truncated Taylor approximation polynomials:

$$z_1=g(z_0),$$

$$z_2=g(z_0)+\Delta g'(z_0)+\Delta^2/2g''(z_0),$$

$$z_3=g(z_0)+\delta g'(z_0)+\delta^2/2g''(z_0),$$

$$z_4=g(z_0)+2\Delta g'(z_0)+(2\Delta)^2/2g''(z_0),$$

$$z_5=g(z_0)+(\delta+\Delta)g'(z_0)+(\Delta+\delta)^2/2g''(z_0), \text{ and}$$

$$z_6=g(z_0)+(\delta+2\Delta)g'(z_0)+(2\Delta+\delta)^2/2g''(z_0).$$

It can easily be shown that $$z_3-z_1=\delta g'(z_0)+\delta^2/2g''(z_0),$$

$$z_5-z_2=\delta g'(z_0)+(\Delta\delta+\delta^2/2)g''(z_0), \text{ and}$$

$$z_6-z_4=\delta g'(z_0)+(2\Delta\delta+\delta^2/2)g''(z_0).$$

Thus, $$(z_3-z_1)+(z_5-z_2)+(z_6-z_4)=3\delta g'(z_0)+(3\Delta\delta+3\delta^2/2)g''(z_0).$$

In the same manner, $$z_2-z_1=\Delta g'(z_0)+\Delta^2/2g''(z_0),$$

$$z_4-z_2=\Delta g'(z_0)+3\Delta^2/2g''(z_0),$$

$$z_5-z_3=\Delta g'(z_0)+(\Delta\delta+\Delta^2/2)g''(z_0), \text{ and}$$

$$z_6-z_5=\Delta g'(z_0)+(\Delta\delta+3\Delta^2/2)g''(z_0).$$

Thus, $$(z_2-z_1)+(z_4-z_2)+(z_5-z_3)+(z_6-z_5)=4\Delta g'(z_0)+(2\Delta\delta+4\Delta^2)g''(z_0).$$

Since $\delta$ and $\Delta$ are assumed to be relatively small, the assumption may be made that $\delta\Delta g''(z_0)$, $\delta^2 g''(z_0)$, and $\Delta^2 g''(z_0)$ are relatively small compared to $g'(z_0)$. With such an assumption, the ratio of $\delta$ to $\Delta$ may be written as follows:

$$\delta/\Delta = \frac{4}{3}\{(z_3 - z_1) + (z_5 - z_2) + (z_6 - z_4)\}/\{(z_2 - z_1) + (z_4 - z_2) + (z_5 - z_3) + (z_6 - z_5)\}.$$

Thus, $$\delta = \frac{4}{3}\Delta\{(z_3 - z_1) + (z_5 - z_2) + (z_6 - z_4)\}/(z_6 - z_3 + z_4 - z_1).$$

The distance $\Delta$ is known, and so the distance $\delta$ may be determined with knowledge of reference elevations $z_1$, $z_2$, $z_3$, $z_4$, $z_5$, and $z_6$, which may be determined by the methods described above and illustrated in FIG. 10.

Alternatively, in the above-described embodiment illustrated in FIG. 10, the elevation differences $z_2-z_1$, $z_4-z_2$, $z_5-z_3$, and $z_6-z_5$ should each be approximately equal to spacing $\Delta$ in the substantial absence of irregular tool motions and cable stretching.

Therefore, $$4\Delta \approx (z_2-z_1)+(z_4-z_2)+(z_5-z_3)+(z_6-z_5).$$

The elevation differences $z_3-z_1$, $z_5-z_2$, and $z_6-z_4$ should each be approximately equal to distance $\delta$ where irregular tool motions and cable stretching are substantially negligible.

Therefore, $$3\delta \approx (z_3-z_1)+(z_5-z_2)+(z_6-z_4).$$

The above equations may be combined to obtain a relationship that may hold for cases in which irregular tool motions and/or cable stretching are not negligible. With the assumption that $4\Delta$ differs from the term, $(z_6-z_3+z_4-z_1)$, by about the same proportion that $3\delta$ differs from the term, $(z_3-z_1)+(z_5-z_2)+(z_6-z_4)$, the ratio of distance $\delta$ to spacing $\Delta$ may be written:

$$\delta/\Delta = \frac{4}{3}\{(z_3 - z_1) + (z_5 - z_2) + (z_6 - z_4)\}/(z_6 - z_3 + z_4 - z_1).$$

That is, $$\delta = cf\{(z_3-z_1)+(z_5-z_2)+(z_6-z_4)\},$$

where cf is the correction factor, $$\frac{4}{3}\Delta/(z_6 - z_3 + z_4 - z_1),$$

introduced to correct measurement error due to irregular tool motions and cable stretching. Distance $\delta$ can be calculated using this relation once the reference elevations are determined. The distance D can be calculated by summing distance $\delta$ and distance L.

Although the distance $\delta$ is greater than spacing $\Delta$ and less than twice spacing $\Delta$ in the embodiment illustrated by FIG. 10, it is to be understood that a relation for distance $\delta$ in terms of spacing $\Delta$ and the measured reference elevations $z_1-z_6$ could be formulated by the above-described methods for cases in which (a) distance $\delta$ is less than the spacing $\Delta$, or (b) distance $\delta$ is greater than twice the spacing $\Delta$. It is also to be understood that more than 6 detectors may be used in the determination of D and additional relations may be formulated by the methods described above.

It has been found that methods of the present invention typically provide an estimate of distance D with an error of less than about 0.1 inches. In all of the above-described embodiments, it is to be understood that the reference elevations may be measured and/or recorded in any order. The tool may be positioned vertically by moving the tool in a substantially upward direction, a substantially downward direction, or a combination thereof. It is also to be understood that the reference elevations may be determined by (a) measuring the elevation change of a reference portion of the tool, (b) measuring the elapsed time in which a reference portion of the tool moves at a known velocity, or (c) determining the length of a reference portion of the tool that is inserted below the surface of the formation or withdrawn from within the formation.

In an embodiment of the invention, an automatic monitoring system 16 (shown in FIG. 4) is used to measure elevations of a reference portion of the tool. Automatic monitoring system 16 may be adapted to receive detector signals from at least one of the detectors. It is preferred that monitoring system 16 be adapted to receive a digital or analog signal from each detector of the tool. Monitoring system 16 preferably receives a signal from a detector substantially at the precise moment that the detector senses a signal emitted from an embedded marker. The signal received by monitoring system 16 from a detector may prompt the monitoring system to immediately determine a reference elevation. The detectors may detect a signal from an embedded marker over a relatively short time period and generate a profile of the signal that indicates the strength of the signal. Methods for the determination of the marker location from such a profile are well known to those skilled in the art. The automatic monitoring system is preferably adapted to obtain a reference elevation measurement at a precise moment during the generation of the profile (e.g., at the moment when the profile is at a maximum). The monitoring system preferably includes a computer 18 adapted to interpret logging data (e.g., gamma ray detection profiles) and perform calculations involving the measured reference elevation values, known distances between detectors, etc., such that the system can calculate the distance D between the two markers and/or predict or detect the onset or occurrence of formation subsidence. Monitoring system 16 is preferably adapted to perform calculations involving relations for $\delta$ and the correction factor cf formulated by the principles and methods previously set forth.

In some cases, the tool casing 4 may expand or contract due to thermal effects. The spacings between the detectors are typically precisely measured above the surface of the formation at ambient temperature. The thermal expansion or contraction of the tool casing 4 may be significant at the temperature within the formation. For instance, a 30 foot long spacing distance along the casing at 70° F. will typically expand by about 0.55 inches when raised to a temperature of 300° F. Tool 2 preferably contains a temperature sensor located proximate tool casing 4 that is adapted to relay a signal to automatic monitoring system 16 as a function of the temperature in the vicinity of the tool casing. Appropriate correlations may be used to account for the expansion of tool casing 4 and change in detector spacings due to thermal effects. The use of such correlations is well known to those skilled in the art.

In an embodiment of the invention, tool casing 4 is constructed to allow the spacings between detectors to be varied as desired. The tool casing 4 preferably contains a plurality of sites at which a selected number of detectors may be attached. The outside width (e.g., diameter) of the tool casing 4 is preferably less than about 3 inches, and more preferably between about 1.5 inches and about 2 inches. The casing 4 is also preferably adapted to house casing collar locators at a plurality of locations.

In an embodiment of the invention, an accelerometer is used to detect irregular tool motions. The accelerometer is preferably coupled to tool casing 4 and contains a spring and a sensor adapted to measure the tension in the spring. A mass is attached to the spring such that the tension in the spring is a function of the acceleration of the tool casing as the tool is moved within the formation. Accelerometer measurements may be used to further correct the reference elevation measurements of the reference portion of the tool.

The logging speed of the tool (i.e., the speed that the tool is moved within the formation) is preferably selected as a function of the radioactive strength of the markers and the lateral distance between the detectors and the markers. Generally, increasing the logging speed decreases the irregular motions of the tool, however decreasing the logging speed tends to provide more precise gamma ray logging data. The logging speed of the tool is preferably maintained between about 5 feet per minute and about 15 feet per minute. The frequency with which gamma ray data sampling occurs also may affect the precision of the logging data. In an embodiment of the invention, the detectors of the tool collect gamma ray data each time that the tool casing 4 moves about one-tenth of an inch.

A Lorentzian response model may be used to analyze the gamma ray logging data to precisely determine the vertical and lateral location of the markers embedded in the formation.

Figure 11:
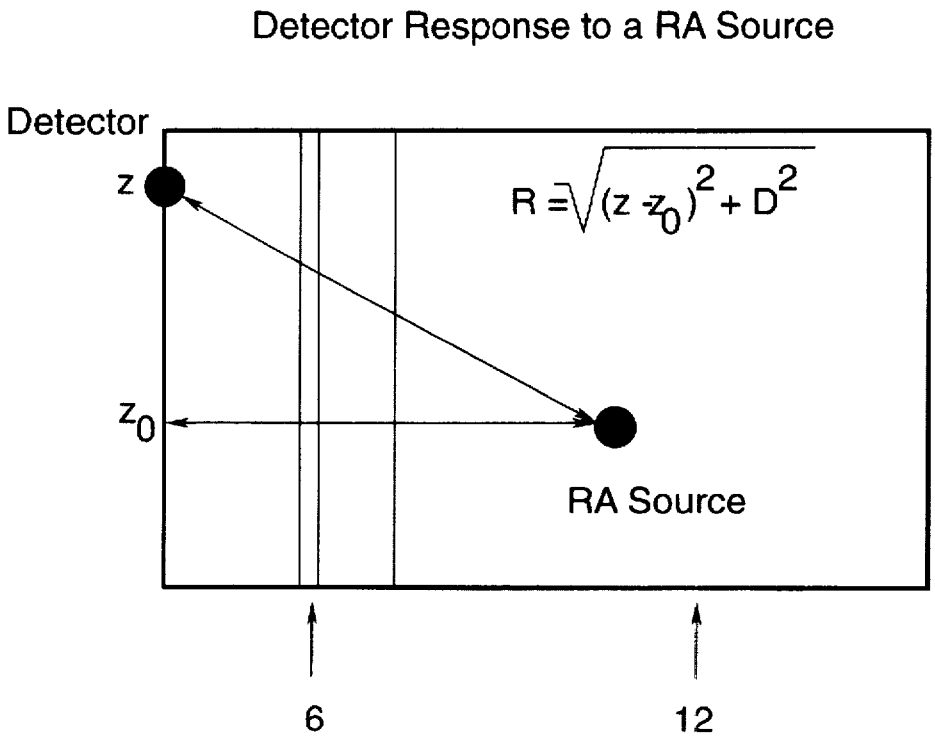
FIG. 11 depicts a model of a gamma ray source and a detector within a well casing.

FIG. 11 shows a model of a point-like gamma-ray source (e.g., marker) and a single detector in the borehole casing. For a detector located at z having a vertical length dz, the gamma-ray counts dI at the detector may be expressed by the following relation:

$$dI(z) = \eta I_0(z_0)\frac{d\Omega}{4\pi}\exp\left(-\sum_i \mu_i l_i\right)dz$$

where $I_0$ is the radioactive strength of a radioactive source located at $z_0$, $\eta$ is the detector efficiency, $d\Omega/4\pi$ is the solid angle, and $\mu_i$ and $l_i$ are the attenuation coefficient and the linear distance, respectively, of the medium "i" between the source and the detector. The solid angle is determined by the relation, $$\frac{d\Omega}{4\pi} = \frac{dA}{(z-z_0)^2+\Gamma^2}$$

where z is the vertical location of the detector, $z_0$ is the vertical location of the source, and $\Gamma$ is the lateral distance between the source and the logging axis, and dA is the area of the detector. The effect of the detector's vertical length can be accounted for by integrating over the length of the detector.

The above equations indicate that the vertical response of the gamma-ray count rate is given by an attenuating Lorentzian distribution:

$$I(z) = A\frac{1}{(z-z_0)^2+\Gamma^2}e^{-\mu\sqrt{(z-z_0)^2+\Gamma^2}} + B.$$

When the source is placed near to the detector and $$\sum_i \mu_i l_i = \mu\sqrt{(z-z_0)^2+\Gamma^2} << 1$$

the gamma count rate may be approximated by a Lorentzian distribution:

$$I(z) = A\frac{1}{(z-z_0)^2+\Gamma^2} + B.$$

This Lorentzian distribution exhibits the half width of $2\Gamma$. This constrains the length of the detector, L, to be less than the half width ($L<<2\Gamma$) in order to resolve the gamma-ray distribution and identify the location of the source. It is noted that the finite length of the detector tends to cause broadening of the vertical response I(z):

$$I(z) = \frac{A}{\Gamma L}\,\text{acrtan}\left(\frac{\Gamma L}{(z-z_0)^2+\Gamma^2-(L/2)^2}\right) + B.$$

where L is the length of the detector. The half width of this response is $\sqrt{(2\Gamma)^2+L^2}$. If the detector cannot be made shorter than the expected half width, the use of a collimator may be desired.

This requirement is quite different from that of conventional gamma-ray logging formations. When gamma sources are assumed as a thin layer, the gamma-ray count rate is determined by integrating above-mentioned expression for dI(z) over the source layer. Then, the resulting distribution is approximated by an exponential decay and its decay constant by an average attenuation coefficient. In a typical sandstone formation, the average attenuation coefficient $\mu$ is about 0.17 $cm^{-1}$ $$\left(\frac{1}{2.26}\text{ inches}^{-1}\right).$$

Making a detector shorter than 2.26" does not typically improve vertical resolution.

When the attenuation factor, $\mu$, is assumed constant and small, there are four parameters in the detector response model. It is noted that $\mu$ is about 0.17 $cm^{-1}$ and the effect of formation attenuation cannot be always ignored. In fact, the effect sharpens the vertical response and the half width of the distribution I(z) appears narrower than $\Gamma$. A more realistic model may be needed to incorporate the formation attenuation effect. These parameters can be determined by fitting the vertical response of gamma-ray count rates to a Lorentzian distribution:

$$I(z) = A\frac{1}{(z-z_0)^2+\Gamma^2} + B$$

Alternatively, the data may be analyzed by using an approximate Gaussian distribution, $$I(z) = Fe^{-(z-z_0)^2/G^2} + B,$$

where F is the maximum count rate at the source depth ($F=A/\Gamma^2$) and G is the decay width, which is related to the half width Γ by the relation: Γ=0.8326G. The significance of these parameters is discussed below.

The vertical marker location, $z_0$, is a significant parameter of the log response, since the compaction and subsidence of formations are estimated from the temporal changes in the markers' vertical locations. In the log response, $z_0$ is identified as the location of a gamma count-rate peak.

The lateral distance between a source and the detector, Γ, may be used to infer the depth of marker penetration when the markers are projected into the formation. A temporal change in Γ may indicate that the lateral position of the marker or well casing 6 has changed. Such information may be used to identify anisotropic stress in the formation. Γ is expected to be constant when markers are attached to the wall of well casing 6. In this case, a temporal change in Γ may indicate the presence of buckling and/or other casing deformations. In the log response, Γ is the full width at half maximum; namely, the count rate at $z=z_0$. In reality, the Γ estimate may be shorter than the actual distance if the effect of attenuation (through an exponential factor in the above-mentioned expression for dI(z)) is not negligible.

A is an overall constant which is a product of the detector efficiency, η, and the radioactive source strength, $I_0$. Variation of this parameter among detectors may indicate differing detector efficiencies, while variation among different sources tends to imply differing source intensities. In the log response, the maximum count rate at the depth $z=z_0$ is given by $A/\Gamma^2$.

The background count rate, B, is a product of the detector efficiency, η, and the background strength. B or the ratio B/A may be used to identify lithology of the formation where the markers are located. In the log response, B is the background count rate when the detector is set relatively far from the marker.

EXAMPLE

A tool containing four gamma-ray detectors was used to determine the vertical distance D between two markers. The detectors were housed in a tool casing that was attached to a cable. A winch was used to raise and lower the casing. The spacing between the first detector (GR1) and the second detector (GR2) was 1.023 ft, the spacing between the second detector (GR2) and the third detector (GR3) was 9.972 ft, and the spacing between the third detector (GR3) and the fourth detector (GR4) was 19.993 ft. The tool was positioned within a shallow, vertical well about 114 ft deep. The well casing diameter was about 7 inches. Two $Cs^{137}$ sources (e.g., marker 1 and marker 2) that each had a radioactive strength of 10 μC were fixed on the outside wall of the well casing. The actual distance between marker No. 1 and marker No. 2 was 29 feet and 11 inches.

Two three detector systems may be used with the tool. A system consisting of GR1, GR2, and GR3, may be used for precise compaction measurements using pairs of markers separated by about 10 ft. A system consisting of GR1, GR2, and GR4 may be used for markers separated by about 30 ft. The results of the test run at a logging speed of 10 ft/min are listed on Table 1.

The vertical location (e.g., depth) of individual markers was determined by analyzing the tool response using a Lorentzian fit. Then the distance between a pair of markers was calculated using a three detector method. Shown in Table 1 and Table 2 are results for a pair of markers set 29 ft and 11 inches (29.917 ft) apart.

Applying the single detector method to the data from four detectors, the distance was estimated to be 29.894 ft, which differs by 0.023 ft (0.28 in) from the actual distance. See Table 1. When the two detector method was used the distance was estimated to be 29.908 ft, which differs by 0.009 ft (0.11 in) from the actual distance. The three detector method rendered 29.908 ft, which differs from the actual distance between the two markers by 0.008 ft (0.1 in). In this test run, the tool's movement was smooth enough that no significant correction was observed in accelerometer data. This is also reflected in almost identical results from both the two detector method and the three detector method. See Table 2.

The parameter Γ from the Lorentzian fit stands for the lateral distance between the marker and the detector. Γ estimated from the data is about 0.230 ft (2.76 in), which is consistent with but little shorter than the actual distance of the markers on the wall (3.5" radius) from the NaI detectors (0.5" radius). This shorter estimate may be a result of ignoring the effect of gamma attenuation through the formation. See Table 3.

The consistency among A values for each marker suggests that the detectors were of similar efficiency, and the gamma sources were of similar strength.

TABLE 1

| Detector | Depth of the marker #1 (ft) | Depth of the marker #2 (ft) | Distance between #1 and #2 (ft) |
|---|---|---|---|
| GR1 | 78.286 | 48.403 | 29.884 |
| GR2 | 79.313 | 49.424 | 29.889 |
| GR3 | 89.286 | 59.388 | 29.898 |
| GR4 | 109.276 | 79.369 | 29.908 |
| | | Average | 29.895 |
| | | Actual | 29.917 (29'11") |
| | | Error | 0.022 |

TABLE 2

| | Distance between #1 and #2 (ft) | Error |
|---|---|---|
| Actual distance | 29.917 | |
| 1 detector system | 29.895 | 0.022'(0.27") |
| 2 detector system | | |
| GR1-GR4 | 29.906 | |
| GR2-GR4 | 29.909 | |
| Average | 29.907 | 0.010'(0.11") |
| 3 detector system (GR1, GR2, GR4) | 29.909 | 0.008'(0.09") |

TABLE 3

| Marker | Detector | $z_0$ | D | A | B |
|---|---|---|---|---|---|
| #1 | GR1 | 78.286 | 0.230 | 224.6 | 22.4 |
| | GR2 | 79.313 | 0.229 | 216.4 | 18.5 |
| | GR3 | 89.286 | 0.225 | 204.7 | 18.3 |
| | GR4 | 109.277 | 0.219 | 203.3 | 73.6 |
| #2 | GR1 | 68.299 | 0.227 | 222.6 | 22.9 |
| | GR2 | 69.319 | 0.229 | 228.8 | 23.6 |
| | GR3 | 79.292 | 0.225 | 217.2 | 20.5 |
| | GR4 | 99.270 | 0.225 | 224.7 | 20.3 |
| #3 | GR1 | 58.308 | 0.232 | 233.1 | 27.1 |
| | GR2 | 59.336 | 0.233 | 231.5 | 25.2 |
| | GR3 | 69.306 | 0.226 | 229.2 | 23.4 |
| | GR4 | 89.283 | 0.223 | 230.3 | 23.5 |
| #4 | GR1 | 48.403 | 0.233 | 220.0 | 25.1 |
| | GR2 | 49.424 | 0.233 | 214.1 | 25.4 |
| | GR3 | 59.388 | 0.238 | 216.5 | 27.8 |

TABLE 3-continued

| Marker | Detector | $z_0$ | D | A | B |
|---|---|---|---|---|---|
| | GR4 | 79.369 | 0.231 | 214.7 | 22.1 |
| average | | | 0.229 | 220.7 | 23.1* |

Appendix A

The specification includes an appendix labeled Appendix A titled "Precise Wireline Distance Measurement with a New Formation Compaction Monitoring Tool" by T. Hagiwara, H. Zea, and F. Santa which includes additional description of the preferred embodiment of the invention. Appendix A forms a part of this specification as though fully and completely set forth herein.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

Appendix A

Precise Wireline Distance Measurement With a New Formation Compaction Monitoring Tool Authors:

T. Hagiwara

H. Zea

F. Santa

JUL '11 '96 10:14AM LEGALTRATEGIC & TECHNICAL MKTNG P.2/9

JJTW 4/e 2/96 Precise

Precise Wireline Distance Measurement with a New Formation Compaction Monitoring Tool T. Hagiwara, H. Zea, F. Santa
Halliburton Energy Services, Houston, TX

Abstract

The Formation Compaction Monitoring Tool (FCMT) is a wireline tool that uses multiple gamma-ray detectors to determine locations of and precise distance between radioactive markers planted in the formation or casing. Compaction of the formation can be measured by changes in the distance between the markers. This paper examines the tool response to a marker and explains a new method to determine the exact vertical and lateral location of the marker using a Lorentzian response model. Not only the vertical compaction but also lateral displacement of markers can be monitored using the new method.

For precise estimation of the vertical distance between a pair of markers, the new method uses an array of three detectors. To achieve higher accuracy, a method using a four detector array is also studied.

Because of the tool's unique construction, the spacing between detectors can be easily altered to fit the application. A choice between the three-detector and four-detector arrays is readily provided. The tool temperature is also measured to correct for thermal expansion of the tool. Depth measurements are corrected for irregular tool motions using an uni-axial accelerometer. A pair of induction-type Casing Collar Locators (CCL's) provides additional compaction/depth measurement.

This paper will present the results of test runs. The tools were logged at three logging speeds: 5, 10, and 15 ft/min., and data were collected at 0.1" interval. The vertical distances between a pair of radioactive markers spaced 30 ft apart were measured accurately to within 0.1 inches.

Introduction

Formation subsidence due to formation compaction is a big concern for long-term hydrocarbon production in unconsolidated sand reservoirs. It is important to monitor formation compaction before significant subsidence occurs when formation compaction is expected in the reservoirs.

Formation compaction can be monitored by precision measurement of the distance between a pair of markers planted in the formation or casing. These markers are radioactive sources such as $Cs^{137}$ that has a relatively long half-life time. They can be permanent magnets, instead. When the formation subsides and compaction of the formation takes place, the distance between the pair of markers changes.

Figure 1:
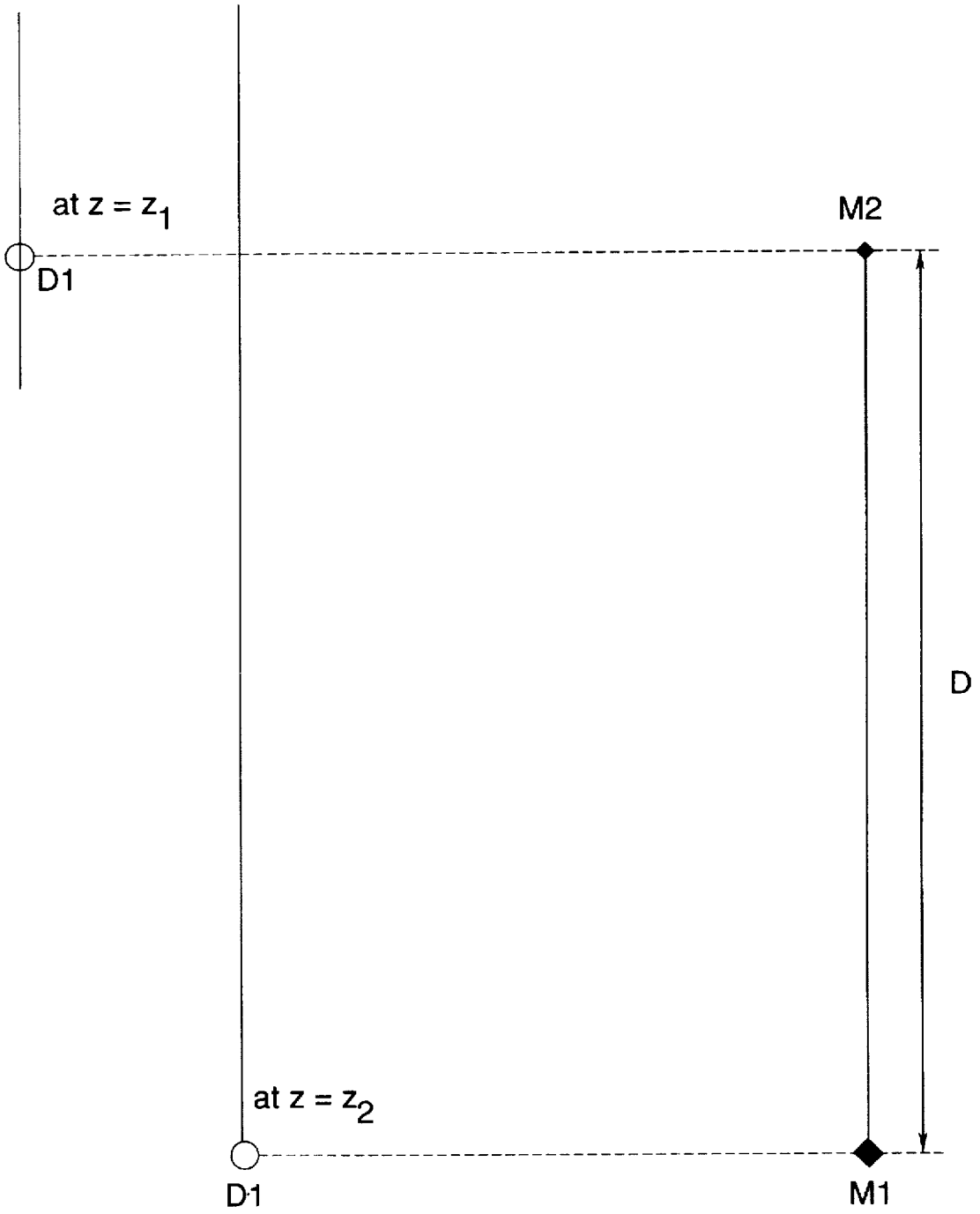
Prior Art Fig. 1
FIG. 1 illustrates a prior art method for detecting formation subsidence using a tool having a single detector.

Formation compaction monitoring tool (FCMT) is a wireline tool made to monitor small amount of formation compaction. The present tool consists of multiple gamma-ray detectors to determine locations of radioactive markers. It is capable of estimating the distance between these markers precisely. Compaction of the formation can be monitored by following temporal changes in the distance between the markers. See Fig. 1.

There are two major issues in making precise measurement of the distance. The first is determination of marker locations. By examining detector responses to a radioactive point source, we developed a method to determine the location of a marker not only vertically but also laterally. The vertical locations are then used to estimate the vertical distance between a pair of markers. The lateral locations are also used to estimate relative horizontal movements of markers.

The second is precise estimation of the distance from the known marker locations. Previously a pair of detector is set at a distance nearly equal to the expected distance between a pair of markers, in order to obtain more accurate distance measurements. We developed a new method which uses the third and the fourth detectors at particular spacing to measure the distance between the markers more accurately.

These two issues are discussed below in detail.

FCMT is a through-tubing tool that can be run in production wells. Because of the tool's unique construction, the spacing between detectors can be easily altered to fit the application. A choice between the three-detector and four-detector arrays is readily provided. Several other features are also added to secure high precision measurement.

- The tool temperature is measured to correct for thermal expansion of the tool.
- Depth measurements are corrected for irregular tool motions using an uni-axial accelerometer.

- A pair of induction-type Casing Collar Locators (CCL's) provides additional compaction/depth measurement.

We tested the FCMT in a test facility in Houston and examined if the method described above could render accurate enough measurements. Four radioactive markers were placed precisely at pre-determined distance on the outer wall of the casing. We ran four tools, at three logging speeds: 5, 10, and 15 ft/min. with data sampled every 0.1". The vertical distances between a pair of radioactive markers were measured accurately to within 0.1 inches over 30 ft. The average lateral distance to the markers was estimated to be 0.23 ft (=2.76 in.), which is approximately the distance between the casing outer wall and the gamma-ray detector. The results of test runs are discussed below.

Determination of a marker location

By examining detector response to a point marker, we developed a new method to determine the location of the marker precisely. Not only the vertical but also the lateral location can be determined.

Figure 2:
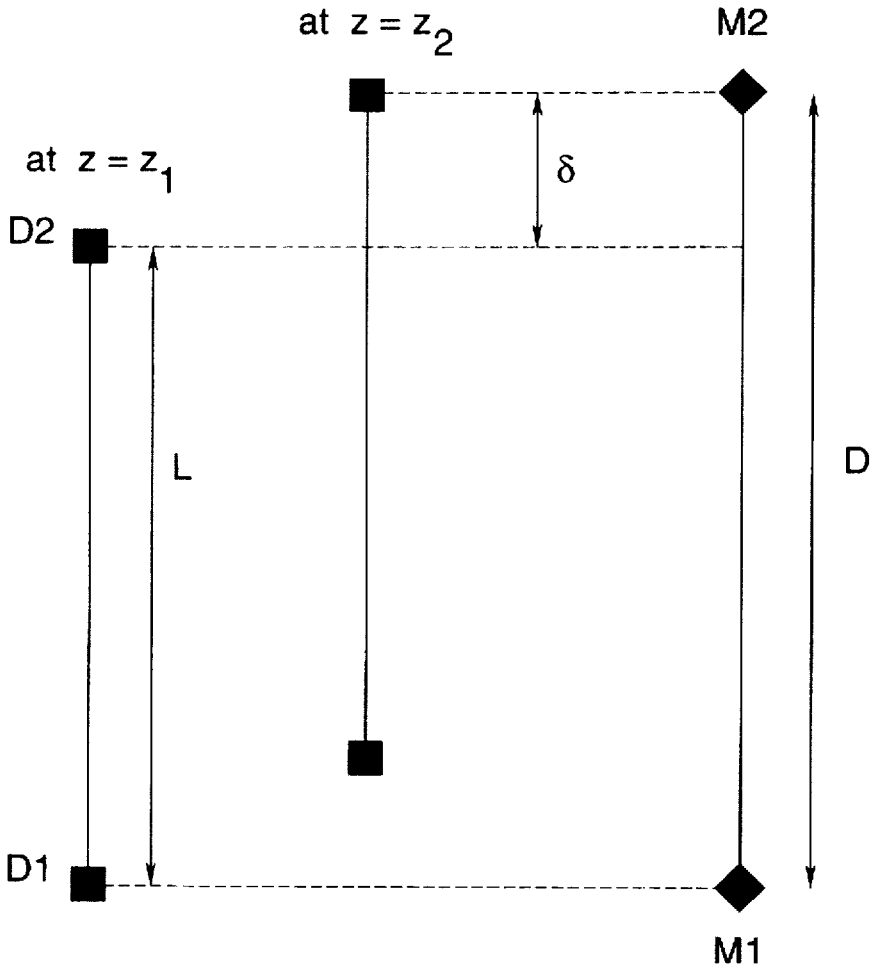
Prior Art Fig. 2
FIG. 2 illustrates a prior art method for detecting formation subsidence using a tool having two detectors.

Detector response to a marker. Fig. 2 shows a model of a point-like gamma-ray source (marker) and a single detector in the casing. The gamma-ray counts dI at the detector which is located at z and whose vertical size is dz, is given by $$dI(z) = \eta I_0(z_0)\frac{d\Omega}{4\pi}\exp\left(-\sum_i \mu_i l_i\right)dz \qquad (1)$$

where $I_0$ is the strength of a source located at $z_0$, $\eta$ the detector efficiency, $d\Omega/4\pi$ the solid angle, and $\mu_i$ and $l_i$ are the attenuation coefficient and the linear distance of the medium "i" between the source and the detector. The solid angle is determined by the distance between the source and the detector as, $$\frac{d\Omega}{4\pi} = \frac{dA}{(z-z_0)^2+D^2} \qquad (2)$$

where z is the vertical location of the detector, $z_0$ the vertical location of the source, and D the lateral distance between the source and the logging axis. dA is the area of the detector. The effect of the detector's vertical length can be easily incorporated by integrating over the length of the detector.

The above equations indicate that the vertical response of the gamma-ray count rate is given by an attenuating Lorentzian distribution:

$$I(z) = A\frac{1}{(z-z_0)^2+D^2}e^{-\mu\sqrt{(z-z_0)^2+D^2}} + B. \qquad (3)$$

When the source is placed near to the detector and $$\sum_i \mu_i l_i = \mu\sqrt{(z-z_0)^2+D^2} << 1, \qquad (4)$$

the gamma count rate is approximated by a Lorentzian distribution:

$$I(z) = A\frac{1}{(z-z_0)^2+D^2} + B. \qquad (5)$$

This Lorentzian distribution exhibits the half width of 2D. This constrains the length of the detector, L, to be less than the half width (L << 2D) in order to resolve the gamma-ray distribution and identify the location of the source[F1]. If the detector cannot be made shorter than the expected half width, the use of a collimator may be desired.

This requirement is quite different from that of conventional gamma-ray logging in formations. When gamma sources are assumed as a thin layer, the gamma-ray count rate is determined by integrating Eq.1 over the source layer. Then, the resulting distribution is approximated by an exponential decay and its decay constant by an average attenuation coefficient. In a typical sandstone formation, the average attenuation coefficient $\mu$ is about 0.17 $cm^{-1}$ (=1/2.26"). Making a detector shorter than 2.26" does not improve vertical resolution.

Parameters of the model. When the attenuation factor, $\mu$, is assumed constant and small[F2], there are four parameters in the detector response model. These parameters can be determined by fitting the vertical response of gamma-ray count rates to a Lorentzian distribution[F3]:

$$I(z) = A\frac{1}{(z-z_0)^2+D^2} + B \qquad (6)$$

The significance of these parameters is discussed below.

---

F1 Finite length of the detector causes broadening of the vertical response I(z):

$$I(z) = \frac{A}{DL}\arctan\left(\frac{DL}{(z-z_0)^2+D^2-(L/2)^2}\right) + B$$

where L is the length of the detector. The half width of this response is $\sqrt{(2D)^2+L^2}$.

F2 In reality, $\mu$ is about 0.17 $cm^{-1}$ (=1/(2.26")) and the effect of formation attenuation cannot be always ignored. In fact, the effect sharpens the vertical response and the half width of the distribution I(z) appears narrower than D. A more realistic model may be needed to incorporate the formation attenuation effect.

F3 Instead, the data may be analyzed by using an approximate Gaussian distribution, $$I(z) = Fe^{-(z-z_0)^2/G^2} + B,$$

where F is the maximum count rate at the source depth ($F=A/D^2$) and G is the decay width related to the half width D by D=0.8326G.

$z_0$: marker location (vertical). This is the most important parameter in the FCMT response, as compaction and subsidence of formations are estimated from the temporal changes in the markers' vertical locations. In the log response, $z_0$ is identified as the location of a gamma count-rate peak.

D: marker location (lateral). The lateral distance between a source and the detector may be used to infer the depth of marker penetration when the markers are shot into the formation. Temporal change in D may indicate lateral movement of the marker or casing (logging position) in time. Such information may be used to identify anisotropic stress in the formation. D is expected to be constant when markers are planted on the casing wall. In this case, temporal change in D may indicate buckling and other casing deformations. In the log response, D is the full width at half maximum; namely, the count rate at $z-z_0=\pm D$ is a half of the maximum count rate at the peak $z=z_0$. In reality, the D estimate may be shorter than the actual distance if the effect of attenuation (through an exponential factor in Eq. 1) is not negligible.

A: an overall constant which is a product of the detector efficiency, $\eta$, and the source strength, $I_0$. Variation of this parameter among detectors may indicate different detector efficiencies, while variation among different sources implies different source intensities. In the log response, the maximum count rate at the depth $z=z_0$ is given by $A/D^2$.

B: background count rate, which is a product of detector efficiency, $\eta$, and the background strength. B or B/A may be used to identify lithology of the formation where markers are located.
In the log response, B is the background count rate when the detector is set far from the marker.

Estimate of distance between two markers: previous methods

Depending on the number of detectors, distance between two markers, H, can be estimated differently, when the depth location, $z_0$, of each marker is determined by respective detectors.

One detector system. The distance between two markers can be measured by simply measuring the depth of the two markers by running one detector (sensor) vertically. Let $z_1$ and $z_2$ be the locations determined by the detector for markers #1 and #2, respectively. Then H is estimated from the difference, $H=z_2-z_1$, assuming that individual measurements of marker location, $z_1$ and $z_2$ are correct. However, the depth recorded at the surface is not necessarily identical to the actual depth because of cable stretch and cable yo-yo motions. Consequently, the distance estimated using a single detector may not be accurate.

Two detector system. To minimize the effects from cable motions, two detectors are placed at a distance, L, nearly equal to the distance between two markers, H. See Fig.3a. Let $z_1$ be the depth reading by the first detector at the marker #1 and $z_2$ the depth reading by the second detector at the marker #2, respectively. Then H is estimated from the difference, $H=z_2-z_1+L$. Unlike in the one detector system, the distance the tool moves from $z_1$ to $z_2$ is $d=H-L$, which is much shorter than L itself. Hence, the effect of tool motion is assumed to be much smaller during that period, and the measured H is expected to be more accurate.

Three or more detector system. The spacing between the two detectors must be very close to the distance between two markers for the two detector system to render accurate distance measurements. Not knowing the actual distance between two markers, one or more detectors may be added near to the first or the second detector so that the distance between at least one pair of detectors can be sufficiently close to the marker distance. See Fig.3b. Alternatively, the distance may be estimated as an average between the two measurements from two detector pairs, using the second pair as a redundant measurement.

New method of estimating distance between two markers

Using three or four detectors, one can correct the effect of tool motion from the distance measurements. Speed correction can be made using three detectors. By placing four detectors in a specific way as shown below, the higher order effect can be corrected to provide more accurate distance estimates.

Principle of new method. In this new method, four detectors are used as in Fig.4. Namely, two identical two detector system with detector spacing, L, are vertically offset by the distance $\Delta$. Let $z_1$ be the logging depth recorded by detector #1 at the first marker #1 at the true depth $z_0$. Likewise, $z_2$ be the depth recorded by the detector #2, which is placed at a spacing L above the detector #1, at the second marker #2, which is located at the distance $\delta z$ above the marker #1. Also, $z_3$ be the depth recorded by the detector #3, which is placed at a spacing $\Delta$ above the detector #1, at the marker #1, and $z_4$ be the depth recorded by the detector #4, placed at a spacing $\Delta$ above the detector #3.

The tool's logging depth at each occasion when each detector passes a marker, #1 or #2, is described as a

JUL 11 '96 10:16AM LEGALTRATEGIC & TECHNICAL MKTNG P.5/9 function of the true depth of the tool (the depth of detector #1) as follows:

$$z_1=g(z_0) \quad (7)$$
$$z_2=g(z_0+\delta)$$
$$z_3=g(z_0+\Delta)$$
$$z_4=g(z_0+\Delta+\delta)$$

For small distance $\Delta$ and $\delta$, the tool's depth may be written by, $$z_1=g(z_0) \quad (8)$$
$$z_2=g(z_0)+\delta\, g'(z_0)+\delta^2/2\, g''(z_0)$$
$$z_3=g(z_0)+\Delta\, g'(z_0)+\Delta^2/2\, g''(z_0)$$
$$z_4=g(z_0)+(\Delta+\delta)\, g'(z_0)+(\Delta+\delta)^2/2\, g''(z_0)$$

Note that $z_2-z_1=\delta g'(z_0)+\delta^2 g''(z_0)/2$. In the previous two detector system, the difference $\delta$ is estimated from the logging depth measurements as $\delta=z_2-z_1$. The previous estimate is correct only for $g'(z0)=1$ and $g''(z_0)=0$. However, the logging depth recorded at the surface is not generally identical to the actual tool depth because of cable stretch and yo-yo motions. As a result, these assumptions are rarely satisfied and corrections must be made to obtain the accurate difference $\delta$ from log measurements.

It is straightforward to show that four measurements are necessary to make accurate estimate of $\delta$. Note $$z_2-z_1=\delta\, g'(z_0)+\delta^2/2\, g''(z_0) \quad (9)$$
$$z_4-z_3=\delta\, g'(z_0)+(\Delta\delta+\delta^2/2)\, g''(z_0)$$

then, $$z_2-z_1+z_4-z_3=2\delta\{g'(z_0)+(\Delta+\delta)/2\}g''(z_0). \quad (10)$$

Likewise, $$z_3-z_1=\Delta\, g'(z_0)+\Delta^2/2\, g''(z_0) \quad (11)$$
$$z_4-z_2=\Delta\, g'(z_0)+(\Delta\delta+\Delta^2/2)\, g''(z_0)$$

then, $$z_3-z_1+z_4-z_2=2\Delta\{g'(z_0)+(\Delta+\delta)/2\}g''(z_0). \quad (12)$$

Consequently, one finds that $$\delta/\Delta=(z_2-z_1+z_4-z_3)/(z_3-z_1+z_4-z_2). \quad (13)$$

Since $\Delta$ is known *a priori* as the spacing between the detector #1 and #3, the difference $\delta$ can be obtained from the four logging depth measurements $\{z_1, z_2, z_3$, and $z_4\}$.

For a three detector system consisting of detectors #1, #2, and #3, one finds an approximation, $$\delta/\Delta=(z_2-z_1)/(z_3-z_1) \quad (14)$$

for $\delta g''(z_0)$, $\Delta g''(z_0) << g'(z_0)$.

H estimate using three or four detectors. The distance between the two markers, H, is measured by $H=L+\delta$ where $\delta$ is determined for a four detector system by, $$\delta=\Delta\,(z_2-z_1+z_4-z_3)/(z_3-z_1+z_4-z_2). \quad (15)$$

where tool offset $\Delta$ is known *a priori*. This should be compared to the previous method, where the difference $\delta$ is determined from measurements by $\delta=z_2-z_1$.

When the fourth detector is not available, a three detector system consisting detectors #1, #2, and #3, can still make precise measurements, though less precise than using all four detectors above. Namely, in the present method, $\delta$ is estimated approximately by, $$\delta=\Delta\,(z_2-z_1)/(z_3-z_1). \quad (16)$$

Other operational concerns

All the above discussions concern the method to make precise distance measurements. In actual logging environments, a few other operational problems may occur to hinder such precise measurements. Among them, the effect of temperature is non-negligible and spacings among detectors must be corrected when the logging temperature changes significantly. The depth reading at the surface is generally different from the actual depth of a tool in the borehole. To obtain better marker location and minimize the effect of cable motions, the use of supplemental accelerometer measurements may be necessary.

Temperature. The distance between a pair of markers is estimated by $H=L+\delta$ where L is the prefixed distance between a pair of detectors #1 and #2. The difference $\delta$ is measured by determined by $\delta=\Delta(z_2-z_1)/(z_3-z_1)$ for a three detector system and by $\delta=\Delta(z_2-z_1+z_4-z_3)/(z_3-z_1+z_4-z_2)$ for a four detector system where $\Delta$ is the prefixed distance between detectors #1 and #3. For accurate measurements of H, the two spacings, L and $\Delta$, must be accurately known. The spacers between the detectors are calibrated at the surface ambient temperatures and they will expand/contract thermally in logging environments. The thermal expansion of the tool is not negligible when the borehole temperature is significantly high. For example, a 30 ft long spacer between two detectors expands by 0.55 inches when the temperature reaches from 70°F to 300°F downhole. To correct the effect, a temperature gauge is installed inside the tool and expansion of the tool is monitored.

Depth correction with accelerometer. The actual depth of the tool in the borehole may not be correctly recorded because cable stretch and yo-yo motions cause errors in reading depth at a surface recording apparatus. To correct cable motion, an uni-axial accelerometer is installed in the tool to monitor speed and acceleration of the tool during the logging. The data from the accelerometer is used for the depth correction.

Improved induction type CCL. For additional depth information and casing identification, a pair of casing collar locators (CCL) are installed. The spacing between the pair of CCL's are selected to match the distance (about 40 ft) between casing joints. Although a faster logging speed is favored to reduce irregular cable motions for accurate depth measurement and for better CCL responses, the use of gamma-ray markers requires the tool to be logged at a slower speed for better gamma-ray statistics. To overcome CCL's difficulty at slow logging speeds, induction-type CCL's are designed and used in the FCMT.

Data sampling at every 0.1". Precision of the distance measurement is critically determined by the frequency of data sampling. To achieve higher precision, the FCMT collects data at every 0.1 inch.

Logging speed. The logging speed must be fast enough to maintain smooth cable motions. On the other hand, the speed must be slow enough to get enough gamma ray counts at the detectors. The count rate depends on the source strength of radioactive markers as well as on the lateral distance from the tool. We recommend to run the tool at 10-15 ft/min. when the radioactive source is about 10 $\mu$C strength and placed on the outer casing wall.

Unitized for tailor-made applications. Radioactive markers are anchored into formations at 30 or 40 ft intervals in many actual monitoring projects. In some other projects, they are placed at 10 ft intervals. To make the FCMT fit to various applications, the tool is made of 4 gamma-ray detector units and spacer units of various lengths in-between. By changing spacer lengths, the FCMT can be designed to make precise distance measurements for any distance between markers. Because of its unitized construction, the choice between the 3 detector array or the 4 detector array is readily available, to fit to applications. In fact, the first FCMT was made of two 3 detector arrays to accomodate a client's request to make precise measurement of two marker distances. Namely, the markers were placed 10 ft apart and the client wanted to monitor changes of both 10 ft and 30 ft intervals.

There are a few other features to be mentioned. First, the outside diameter of the FCMT is 1.6875". The tool can be run through production tubings. Secondly, the FCMT is combinable with other production logging tools, such as TMDL (a trademark of Halliburton Energy Services).

Results from a test well

We tested the FCMT in a test facility in Houston and examined if the method described above could render accurate enough measurements. The test facility is a shallow vertical well (114 ft deep). The 7" casing was used. Four 10 $\mu$C strong $Cs^{137}$ sources were fixed on the outside wall of the casing at 10.00 ft, 10.00 ft, and 9 ft and 11 inches, apart. See Fig.5.

The four gamma-ray detectors are placed at 1.023 ft, 9.972 ft, and 19.993 ft, apart. See Fig.6. Two three detector systems are used in the tool. A system consisting of GR1, GR2, and GR3, are for precise compaction measurements using pairs of markers separated by about 10 ft. while a system consisting of GR1, GR2, and GR4, are for markers separated by about 30 ft. The results of the test run at 10 ft/min. logging speed are listed on Table 1.

Figure 7:
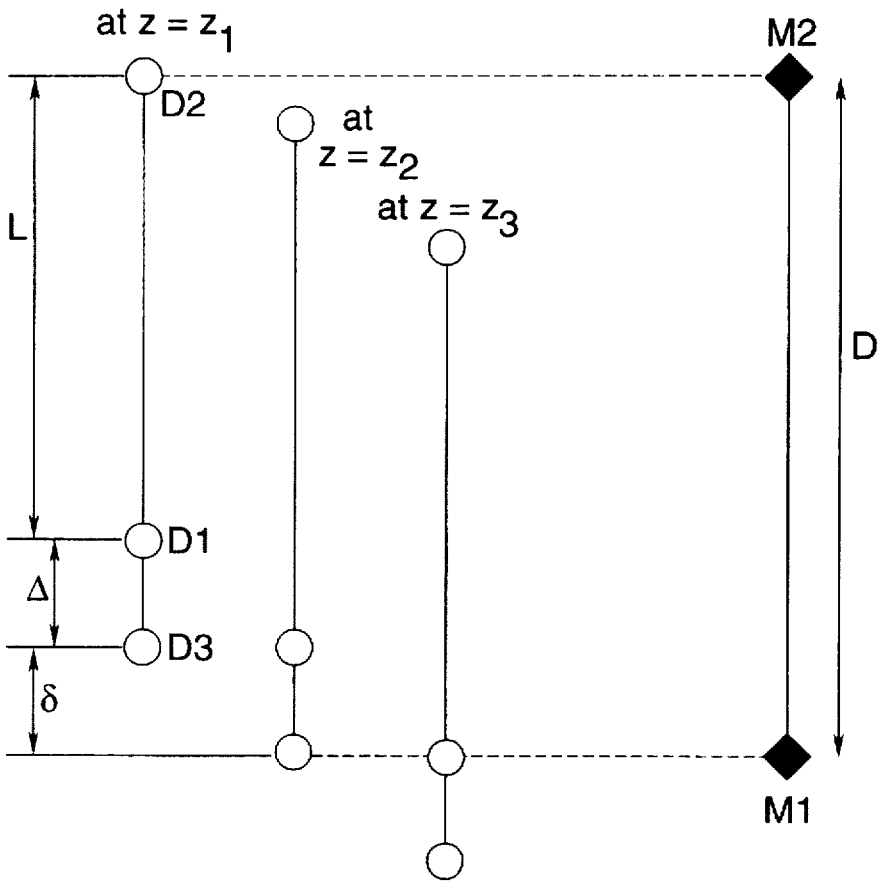
FIG. 7 illustrates an embodiment of the invention for detecting formation subsidence using a tool having three detectors.

Fig.7 is a sample log from this test well.

Vertical distance between markers. Vertical location of individual markers is determined from by analyzing the tool response using a Lorentzian fit. Then the distance between a pair of markers is calculated using a three detector method. Shown in Table 1 and Table 2 are results for a pair of markers set 29 ft and 11 inches (29.917 ft) apart.

Applying the single detector method to the data from four detectors, the distance was estimated to be 29.894 ft, which is 0.023 ft (=0.28 in.) off from the actual distance. See Table 1. When the two detector method was used, the distance was estimated to be 29.908 ft, which is 0.009 ft (0.011 in.) off from the actual distance. The three detector method rendered 29.909 ft, which is 0.008 ft (0.01 in.) off. In this test run, the tool's movement was smooth enough that no significant correction was observed in accelerometer data. This is also reflected in almost identical results from both the two detector method and the three detector method. See Table 2.

Lateral location of markers. The parameter D from the Lorentzian fit stands for the lateral distance between the marker and the detector. D estimated from the data is about 0.230 ft (=2.76 in.), which is consistent with but little shorter than the actual distance of the markers on the wall (3.5" radius) from the NaI detectors (0.5" radius). This shorter estimate may be a result of ignoring the effect of gamma attenuation through the formation. See Table 3.

Source strength. Consistency among A values for each marker suggests that detectors are of similar efficiency, and gamma sources are of similar strength.

Acknowledgment

We are thankful to Halliburton Energy Services for permitting publication of this paper. We are benefitted from discussions with Dr. Fritz Rambow and Arne de Kock of Shell Oil Company.

Nomenclatures $dA$ area of a detector
A count rate at centroid
B background count rate
D lateral distance to a source
H distance between a pair of markers
I measured count rate
$I_0$ source strength
L distance between a pair of detectors
$l_i$ linear distance between a source and a detector
z vertical location of a detector
$z_0$ vertical location of a source
$\Delta$ vertical offset
$\delta$ difference in the distance measurements
$\eta$ detector efficiency
$\mu$ attenuation coefficient of a formation
$d\Omega$ solid angle

References

De Loos, J.M.: "In-situ compaction measurements in Groningen observation wells," *Verhandelingen Kon. Ned. Geol. Mijnbouwk. Gen.* Vol. 28 (1973) 79-104.

Meaghini, M.L.: "Compaction monitoring in the Ekofisk area chalk fields," OTC 5620 presented at the 1988 Annual Offshore Technology Conference, Houston, TX, May 2-5.

Allen, D.R.: "Developments in precision casing joint and radioactive bullet measurements for compaction monitoring," SPE 9933 presented at the 1981 California Regional Meeting, Bakersfield, CA, March 25-26.

Green, D.E.: "Subsidence monitoring in the Gulf Coast," SPE 22834 presented at the 1991 SPE Annual Technical Conference and Exhibition, Dallas, TX, October 6-9.

Overboom, E.J.M., Peeters, M., and Milloy, G.: "Precise distance measurements with gamma-ray logging tools to monitor compaction (PDM)," Paper presented at the 1981 SPWLA 22nd Annual Symposium, June 23-26.

Table 1

| Detector | Depth of the marker #1 (ft) | Depth of the marker #2 (ft) | Distance between #1 and #2 (ft) |
|---|---|---|---|
| GR1 | 78.286 | 48.403 | 29.884 |
| GR2 | 79.313 | 49.424 | 29.889 |
| GR3 | 89.286 | 59.388 | 29.898 |
| GR4 | 109.276 | 79.369 | 29.908 |
| | | Average | 29.895 |
| | | Actual | 29.917 (29' 11") |
| | | Error | 0.022 |

Table 2

| | Distance between #1 and #2 (ft) | Error |
|---|---|---|
| Actual distance | 29.917 | ---- |
| 1 detector system | 29.895 | 0.022' (0.27") |
| 2 detector system | | |
| GR1-GR4 | 29.906 | |
| GR2-GR4 | 29.909 | |
| Average | 29.907 | 0.010' (0.11") |
| 3 detector system (GR1,GR2,GR4) | 29.909 | 0.008' (0.09") |

Table 3

| Marker | Detector | $z_0$ | D | A | B |
|---|---|---|---|---|---|
| #1 | GR1 | 78.286 | 0.230 | 224.6 | 22.4 |
| | GR2 | 79.313 | 0.229 | 216.4 | 18.5 |
| | GR3 | 89.286 | 0.225 | 204.7 | 18.3 |
| | GR4 | 109.277 | 0.219 | 203.3 | 73.6 |
| #2 | GR1 | 68.299 | 0.227 | 222.6 | 22.9 |
| | GR2 | 69.319 | 0.229 | 228.8 | 23.6 |
| | GR3 | 79.292 | 0.225 | 217.2 | 20.5 |
| | GR4 | 99.270 | 0.225 | 224.7 | 20.3 |
| #3 | GR1 | 58.308 | 0.232 | 233.1 | 27.1 |
| | GR2 | 59.336 | 0.233 | 231.5 | 25.2 |
| | GR3 | 69.306 | 0.226 | 229.2 | 23.4 |
| | GR4 | 89.283 | 0.223 | 230.3 | 23.5 |
| #4 | GR1 | 48.403 | 0.233 | 220.0 | 25.1 |
| | GR2 | 49.424 | 0.233 | 214.1 | 25.4 |
| | GR3 | 59.388 | 0.238 | 216.5 | 27.8 |
| | GR4 | 79.369 | 0.231 | 214.7 | 22.1 |
| average | | | 0.229 | 220.7 | 23.1* |

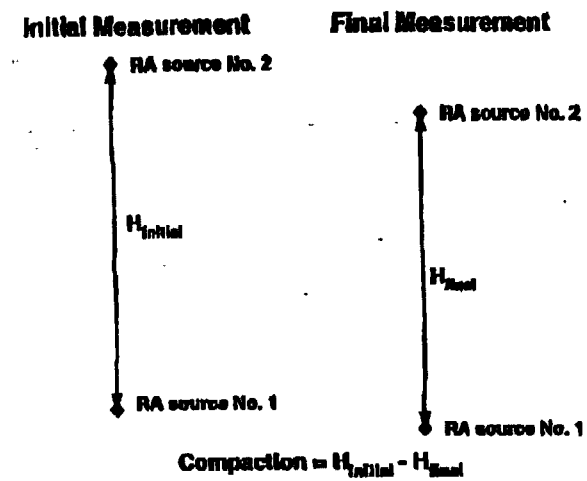
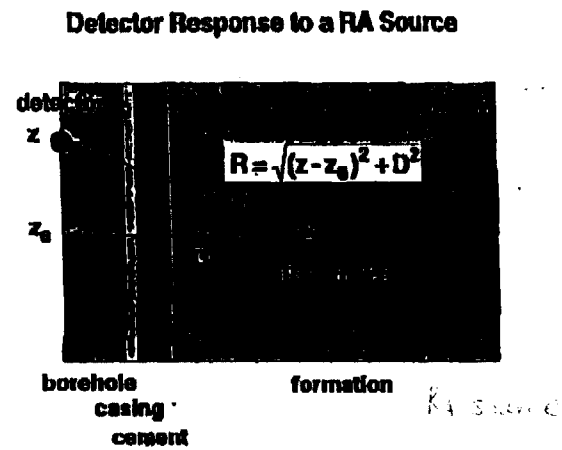
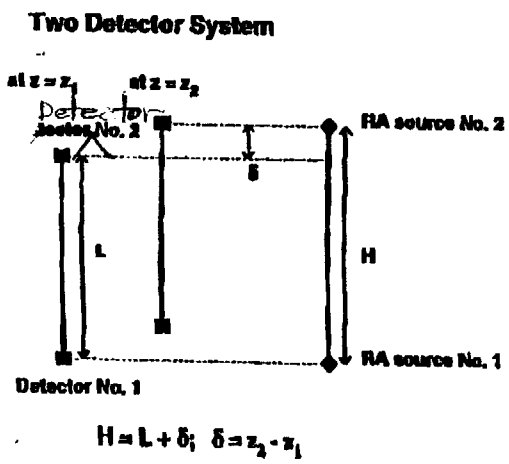
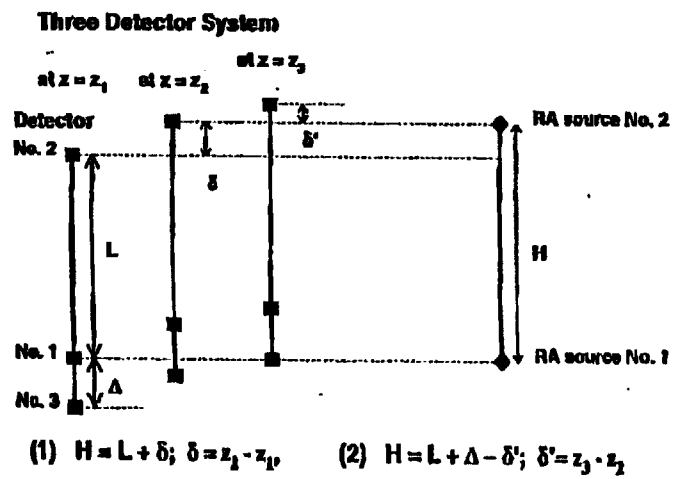
JUL 11 '96 10:17AM LEGAL STRATEGIC & TECHNICAL MKTNG P.8/9

JUL 11 '96 10:17AM LEGAL STRATEGIC & TECHNICAL MKTNG P.9/9
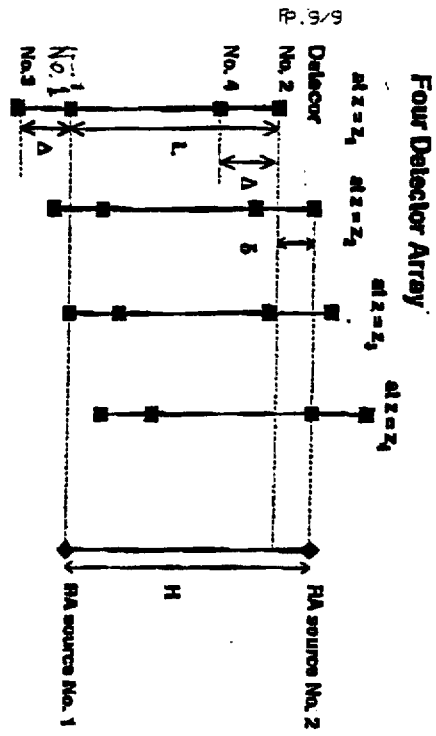
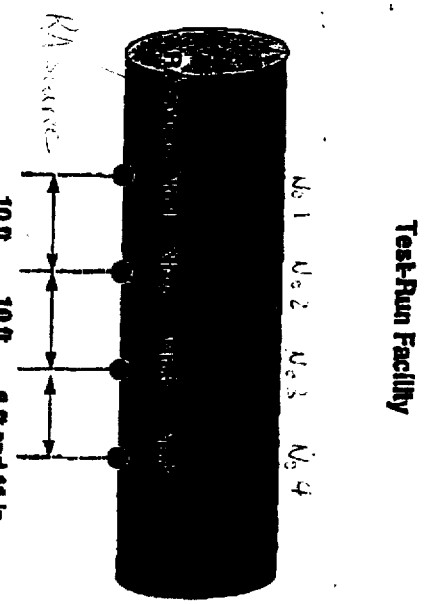
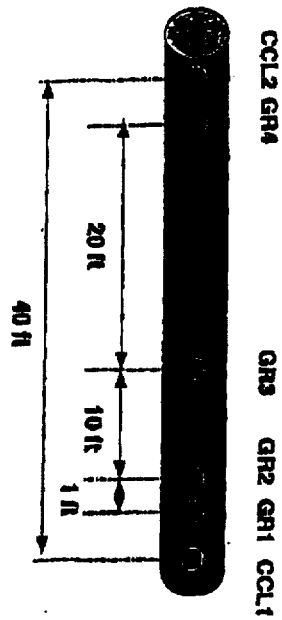

The invention claimed is:

1. A method of measuring compaction or subsidence in earth formation layers by determining a vertical distance D between a first marker and second marker embedded in a formation traversed by a borehole, comprising:

aligning a tool along the borehole in the formation proximate the first marker and the second marker, the tool comprising a reference portion, a first detector, a second detector, and a third detector, the first, second, and third detectors being separated by known distances along the tool, and wherein a known distance Δ exists between at least two of the detectors;

positioning the reference portion of the tool along the borehole at a first reference elevation $z_1$ such that the first detector detects a signal emitted from the first marker;

positioning the reference portion of the tool along the borehole at a second reference elevation $z_2$ such that the second detector detects a signal emitted from the second marker;

positioning the reference portion of the tool along the borehole at a third reference elevation $z_3$ such that the third detector detects a signal emitted from one of the markers; and determining the vertical distance between the first marker and the second marker by multiplying a mathematical expression by a correction factor, the mathematical expression being a function of at least two of the reference elevations $z_1$, $z_2$, and $z_3$, the correction factor being a function of at least two of the reference elevations $z_1$, $z_2$, and $z_3$.

2. The method of claim 1, wherein the correction factor is also a function of the distance Δ.

3. The method of claim 1, wherein the correction factor is a function of at least one reference elevation that is not functionally related to the mathematical expression.

4. The method of claim 1, wherein the vertical distance between the first marker and the second marker is determined by multiplying the mathematical expression, $z_2-z_1$, by the correction factor, $\Delta/(z_3-z_1)$.

5. The method of claim 4, wherein a distance between two of the detectors is greater that the vertical distance D between the first marker and the second marker.

6. The method of claim 1, wherein the vertical distance between the first marker and the second marker is determined by multiplying the mathematical expression, $z_3-z_1$, by the correction factor, $\Delta/(z_2-z_1)$.

7. The method of claim 6, further comprising various spacing distances that exist between the detectors, and wherein the vertical distance between the first marker and the second marker is greater than each of the spacing distances.

8. The method of claim 1, wherein a distance L exists between the first detector and the second detector, the method further comprising determining the vertical distance between the first marker and the second marker by using the following relation:

$$D=L+\Delta(z_1-z_2)/(z_2-z_3).$$

9. The method of claim 8, wherein the tool is lowered during the positioning of the tool at the reference elevations $z_1$, $z_2$, and $z_3$.

10. The method of claim 1, wherein the tool further comprises a fourth detector, the method further comprising positioning the tool at a fourth reference elevation $z_4$ such that the fourth detector senses a signal emitted from one of the markers.

11. The method of claim 10, wherein the first detector and the second detector are separated by the known distance Δ, the second detector and the fourth detector are separated by the known distance Δ, the first detector and the second detector are separated by a known distance L, and the distance D is determined by the following relationship:

$$D=L+\Delta\frac{z_2-z_1+z_4-z_3}{z_3-z_1+z_4-z_2}.$$

12. The method of claim 10, wherein the first detector and the third detector are separated by the known distance Δ, the second detector and the fourth detector are separated by the known distance Δ, the first detector and the second detector are separated by a known distance L, and wherein the sum of 2Δ and L is less than the distance D, and wherein the distance D is determined by the following relationship:

$$D=L+\Delta\frac{z_4-z_2+z_3-z_1}{z_3-z_1+z_4-z_3}.$$

13. The method of claim 10, wherein the tool further comprises a fifth detector and a sixth detector, the method further comprising positioning the tool at a fifth reference elevation $z_5$ such that the fifth detector senses a signal emitted by one of the markers, and the method further comprising positioning the tool at a sixth reference elevation $z_6$ such that the sixth detector senses a signal emitted by one of the markers.

14. The method of claim 13, wherein the known distance Δ separates (a) the first detector and the third detector, (b) the third detector and the fifth detector, (c) the second detector and the fourth detector, and (d) the fourth detector and the sixth detector, and wherein the first detector and the second detector are separated by a known distance L, and the distance D is determined by the following relationship:

$$D=L+\frac{4}{3}\Delta\frac{z_3-z_1+z_5-z_2+z_6-z_4}{z_6-z_3+z_4-z_1}.$$

15. The method of claim 1, wherein the correction factor at least partially compensates for a measurement error induced by irregular tool motions and stretching of the tool.

16. A tool for determining a vertical distance between a first marker and a second marker embedded in a formation, the tool comprising:

a cable;

a first detector;

a second detector;

a third detector located substantially between the first detector and the second detector, the third detector being located at a spacing distance Δ from the second detector;

a casing connected to the cable, the casing housing the detectors;

a tool positioning device adapted to move the cable to change a position of the casing; and an automatic monitoring system adapted to receive detector signals from at least one of the detectors, the monitoring system determining at least three reference elevations of a reference portion of the tool upon receiving the detector signals, and wherein the monitoring system determines the distance D between the two markers at least in part by evaluating a product of a term and a correction factor, the term being a function of at least two of the reference elevations, and the correction factor being a function of at least two of the reference elevations;

and wherein the first detector, second detector, third detector, and fourth detector are each adapted to sense a signal emitted by at least one of the markers.

17. The tool of claim 16, further comprising a fifth detector and a sixth detector, the fifth detector being located substantially between the third detector and the fourth detector at the spacing distance Δ from the third detector, and the sixth detector being located substantially between the third detector and the fourth detector at the spacing distance Δ from the fourth detector.

18. The tool of claim 16, wherein the automatic monitoring system determines four reference elevations $z_1$, $z_2$, $z_3$, and $z_4$ upon receiving the detector signals, and the automatic monitoring system determines the distance D between the two markers by using the following relation:

$$D = L + \Delta \frac{z_2 - z_1 + z_4 - z_3}{z_3 - z_1 + z_4 - z_2}.$$

19. The tool of claim 16, wherein the automatic monitoring system determines six reference elevations $z_1$, $z_2$, $z_3$, $z_4$, $z_5$ and $z_6$ upon receiving the detector signals, and the automatic monitoring system determines the distance D between the two markers by using the following relation:

$$D = L + \frac{4}{3}\Delta\{(z_3 - z_1) + (z_5 - z_2) + (z_6 - z_4)\}/(z_6 - z_3 + z_4 - z_1).$$

20. A method of determining a vertical distance D between a first marker and second marker embedded in a formation traversed by a borehole, comprising:

positioning a tool along the borehole proximate at least one of the markers, the tool having a length and comprising a first detector, a second detector, a third detector, and a fourth detector, and wherein the fourth detector and the second detector are separated by a distance Δ and the third detector and the first detector are separated by the distance Δ and wherein distance D exceeds a distance L between the first detector and the second detector by a distance δ;

positioning a portion of the tool along the borehole at a first elevation, $z_1$, such that the first detector of the tool detects a signal emitted by the first marker;

positioning the portion of the tool along the borehole at a second elevation, $z_2$, such that the second detector of the tool detects a signal emitted by the second marker; and positioning the portion of the tool along the borehole at a third elevation, $z_3$, such that the third detector of the tool detects a signal emitted by the first marker;

positioning the portion of the tool along the borehole at a fourth elevation, $z_4$, such that the fourth detector of the tool detects a signal emitted by the second marker;

determining δ by using the following relationship:

$$\delta = \Delta \frac{z_2 - z_1 + z_4 - z_3}{z_3 - z_1 + z_4 - z_2}; \text{ and}$$

determining D by using the following relationship: D=L+δ.

21. The method of claim 1, wherein the tool comprises more than four detectors.

22. A method of adjusting an estimate of a vertical distance D between a first marker and a second marker disposed in a borehole traversing an earth formation to at least partially correct measurement error due to cable stretching and irregular tool motions, comprising:

aligning a tool along the borehole to a position proximate the markers, the tool comprising a reference portion, a first detector, a second detector, and a third detector, the first detector and the second detector being separated by a spacing distance Δ;

moving the tool along the borehole in a substantially vertical direction and determining an elevation change of a reference portion of the tool between a first time when the first detector senses a signal emitted from the first marker and a second time when the second detector senses a signal emitted from the first marker;

evaluating a ratio of the spacing distance Δ to the elevation change of the reference portion of the tool determined between the first and second times; and adjusting the estimate of distance D by multiplying the estimate of the distance D by the ratio of the spacing distance Δ to the elevation change of the reference portion of the tool.

* * * * *